US010126082B2

(12) United States Patent
Hudson, III et al.

(10) Patent No.: US 10,126,082 B2
(45) Date of Patent: Nov. 13, 2018

(54) SEAR MECHANISM FOR FIREARMS

(71) Applicant: Skunk Labs LLC, Georgetown, TX (US)

(72) Inventors: Billie Cyril Hudson, III, Georgetown, TX (US); Lauren Honor Hudson, Georgetown, TX (US); Keith Eric Becker, Georgetown, TX (US); Mark Thomas Hammond, Elizabethtown, KY (US)

( * ) Notice: Subject to any disclaimer, the term of this patent is extended or adjusted under 35 U.S.C. 154(b) by 0 days.

(21) Appl. No.: 15/255,016

(22) Filed: Sep. 1, 2016

(65) Prior Publication Data

US 2017/0059267 A1 Mar. 2, 2017

Related U.S. Application Data

(60) Provisional application No. 62/212,807, filed on Sep. 1, 2015.

(51) Int. Cl.
*F41A 19/12* (2006.01)
*F41A 19/10* (2006.01)
*F41C 3/00* (2006.01)

(52) U.S. Cl.
CPC ..... *F41A 19/12* (2013.01); *F41A 19/10* (2013.01); *F41C 3/00* (2013.01)

(58) Field of Classification Search
CPC ..... F41A 19/12; F41A 19/10; F41A 3/00
USPC ..... 89/145; 42/69.01, 69.02
See application file for complete search history.

(56) References Cited

U.S. PATENT DOCUMENTS

| | | | | | |
|---|---|---|---|---|---|
| 747,585 | A * | 12/1903 | Browning | F41A 17/64 | 42/7 |
| 2,959,107 | A * | 11/1960 | Sturtevant | F41A 19/45 | 42/69.01 |
| 3,857,322 | A * | 12/1974 | Lichtman | F41A 3/82 | 42/15 |
| 5,086,578 | A * | 2/1992 | Lishness | F41A 19/32 | 42/69.02 |
| 5,320,023 | A * | 6/1994 | Erdem | F41A 3/66 | 42/7 |
| 5,822,903 | A * | 10/1998 | Davis, Sr. | F41A 19/16 | 42/69.01 |
| 6,382,200 | B1 * | 5/2002 | Levkov | F41A 19/12 | 124/71 |
| D746,402 | S * | 12/2015 | Siddle | D22/108 | |
| 9,335,110 | B1 * | 5/2016 | Heizer | F41A 19/29 | |
| 9,777,980 | B2 * | 10/2017 | Heizer | F41A 3/86 | |
| 2004/0159033 | A1 * | 8/2004 | Rohrbaugh | F41A 5/04 | 42/69.03 |
| 2012/0117841 | A1 * | 5/2012 | Joubert | F41A 19/10 | 42/69.01 |
| 2013/0180394 | A1 * | 7/2013 | Siddle | F41A 19/29 | 89/132 |

(Continued)

*Primary Examiner* — Joshua E Freeman
(74) *Attorney, Agent, or Firm* — Matthew E. Burr

(57) ABSTRACT

A rotational sear block isolates the rotational movement of the sear to the sear mechanism without using a rotational trigger. The isolation of the sear rotation to the sear mechanism allows for a single axis translational trigger to be used which gives the shooter the advantages of a short, crisp trigger pull without any off-axis movement. Additionally, the positive sear engagement and inherent safety of the design are achieved due to the sear being engaged and biased onto the sear block surface, disallowing unintended or accidental release.

12 Claims, 33 Drawing Sheets

(56) References Cited

U.S. PATENT DOCUMENTS

| | | | | |
|---|---|---|---|---|
| 2016/0003569 | A1* | 1/2016 | Heizer | F41A 19/29<br>42/69.01 |
| 2016/0047613 | A1* | 2/2016 | Hudson, III | F41A 3/86<br>42/14 |
| 2016/0084600 | A1* | 3/2016 | Siddle | F41A 19/31<br>42/69.01 |
| 2016/0153732 | A1* | 6/2016 | Geissele | B23H 9/00<br>42/69.01 |
| 2017/0059267 | A1* | 3/2017 | Hudson, III | F41A 19/12 |
| 2017/0097204 | A1* | 4/2017 | Geissele | F41A 19/12 |
| 2017/0108304 | A1* | 4/2017 | Heizer | F41A 3/86 |
| 2017/0268843 | A1* | 9/2017 | Heizer | F41A 19/14 |

* cited by examiner

SEAR MECHANISM FOR FIREARMS

CROSS-REFERENCE TO RELATED APPLICATIONS

The present application is related to, is a continuation-in-part of, claims priority from and benefit of U.S. provisional patent application Ser. No. 62/212,807, filed Sep. 1, 2015, the disclosure of which is incorporated herein by reference.

TECHNICAL FIELD

The present invention relates to firearms, and more particularly to a sear mechanism with a disconnector for semi-automatic firing.

BACKGROUND

In a firearm, the sear is the part of the trigger mechanism that holds the hammer, striker or bolt securely until the right amount of pressure has been applied to the trigger when a shooter is ready to fire (trigger break). When enough pressure has been applied to the trigger, the sear releases the firing mechanism. The sear directly influences the "feel" and length or travel of the trigger pull. While a professional shooter may be able to proficiently use many weapons with differing trigger "feel" and pull, it has been demonstrated that novice shooters and professional shooters alike benefit from a short trigger travel and a crisp feeling trigger break.

Specific to pistols, the travel and tactile satisfaction or "feel" of the trigger can have a great impact on a shooter's sight picture and shot placement due to the relatively unsupported posture in a standard shooting stance. In a standard pistol shooting stance, the weapon is being mainly supported by the shooters hands around the grip of the pistol and minimal skeletal support. Whereas, a standard rifle or shotgun shooting stance allows a forward support provided by an extended arm, mid support around the grip of the rifle or shotgun, and rear support provided by the shoulder, creating an inherently more stable shooting position. Additionally, the type of trigger on a pistol can significantly impact the stability of the pistol during the trigger pull, and thus the sight picture and shot placement. The 1911-style trigger constrains the movement of the trigger pull to one axis which is parallel to the bore and prevents the introduction of unintended movement which would disrupt a shooter's sight picture. Conversely, a rotational style trigger requires both translation and rotation about a pivot to actuate and induces off-axis movement on the pistol. This is not a desirable feature as it introduces movement that might cause the shooter's sight picture to shift. The conclusion is that the travel and "feel" of the trigger, along with the direction of force during the trigger pull has a great impact on maintaining a good sight picture and a precise shot placement on a pistol platform.

Multiple pistol sear designs have attempted to create a "crisp" sear release while maintaining a positive sear engagement. A positive sear engagement disallows the ability for the sear to be disengaged other than by pulling the trigger. While many pistol designs have been created with longer and heavier trigger pulls, the designs with short, "crisp" trigger pulls have had more commercial success and a larger shooter demand due to the behavior of the sear. Two such pistols are the 1911 and the Glock™.

The 1911 is a hammer-fired pistol which uses a translational trigger that pulls straight back, which distinguishes it from a rotational trigger. Precise machined angles between the sear and the hammer, in additional to the single axis translational trigger, are what influence the crisp "feel" of the trigger pull. The Glock™ is a striker-fired pistol. A ledge directly between the sear and the striker, as well as the rotational style trigger, determine the "feel" of the trigger pull. Both the 1911 and the Glock™ maintain a positive sear engagement while the respective hammer and striker are held back in the battery ready to fire position.

Both designs have certain drawbacks. The sear of the 1911 is under constant pressure by the hammer. This means that any imperfection in the machining of the engagement ledges between the sear and the hammer may lead to a negative sear engagement and an accidental discharge. The 1911 design accounts for this by the incorporating quality control checks during manufacturing and the inclusion of two manual safeties, and in later designs an additional passive safety. The drawback is that due to the design of the interaction of the sear and the hammer, if strict quality control is not maintained through high volumes of production, it is possible for the occurrence of negative sear engagement. This design, however, along with the single axis translational trigger, does allow for a short, crisp trigger pull.

In the Glock™ design, a rotational trigger translates the movement from the trigger pull to the trigger bar, allowing the sear, which is a geometry on the back of the trigger bar, to release the striker. The drawback of the Glock™ design is that it has an inherently long trigger pull due to the translational connections within the trigger and sear assembly, and the inclusion of a rotational trigger. Unlike the 1911, the Glock™'s sear design is not at risk of quality control issues leading to the possibility of negative sear engagement; however, the inclusion of two passive safeties in addition to the sear itself, lends undesirable effects on the trigger "feel".

There is an unmet need, therefore, for a sear design that allows for a short trigger pull, a crisp trigger "feel", and has an inherently or intentionally positive sear engagement regardless of production volume or quality control.

SUMMARY

The present invention is a rotational sear design. It isolates the rotational movement to the sear block, where other well-designed, positive sear mechanisms are usually achieved by necessitating the inclusion of a rotational trigger. The isolation of this rotation to the sear block allows for a 1911-style trigger yoke to be used which gives the shooter the advantages of a short, crisp trigger pull without any off-axis movement. The positive sear engagement and inherent safety of the design are achieved due to the forces acting on the sear and sear block remaining independent of one another. This also allows for an effectively reproducible length of travel for the trigger lever in this design.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to . . . ." Also, the term "attach" or "attached" where used is intended to mean either an indirect or direct attachment. Thus, if a first component attaches to a second component, that attachment may be through a direct attachment or through an indirect attachment via other components and attachments.

Certain terms are used throughout the following description and claims to refer to particular system components and method steps. As one skilled in the art will appreciate, different companies may refer to a component by different names. This document does not intend to distinguish between components that differ in name but not function.

Figure 1:
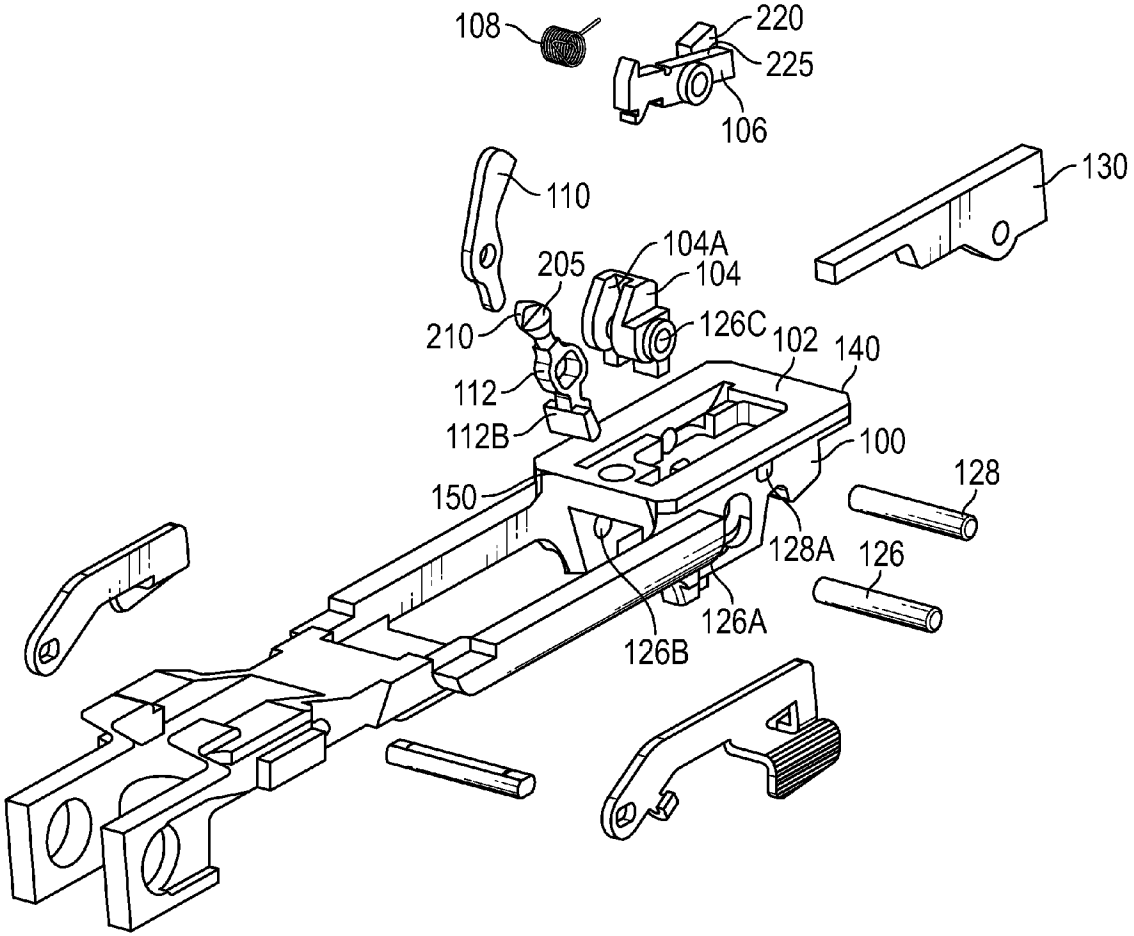
FIG. 1 is an exploded view perspective illustration of an exemplary embodiment of a sear mechanism of the present disclosure.
Figure 11:
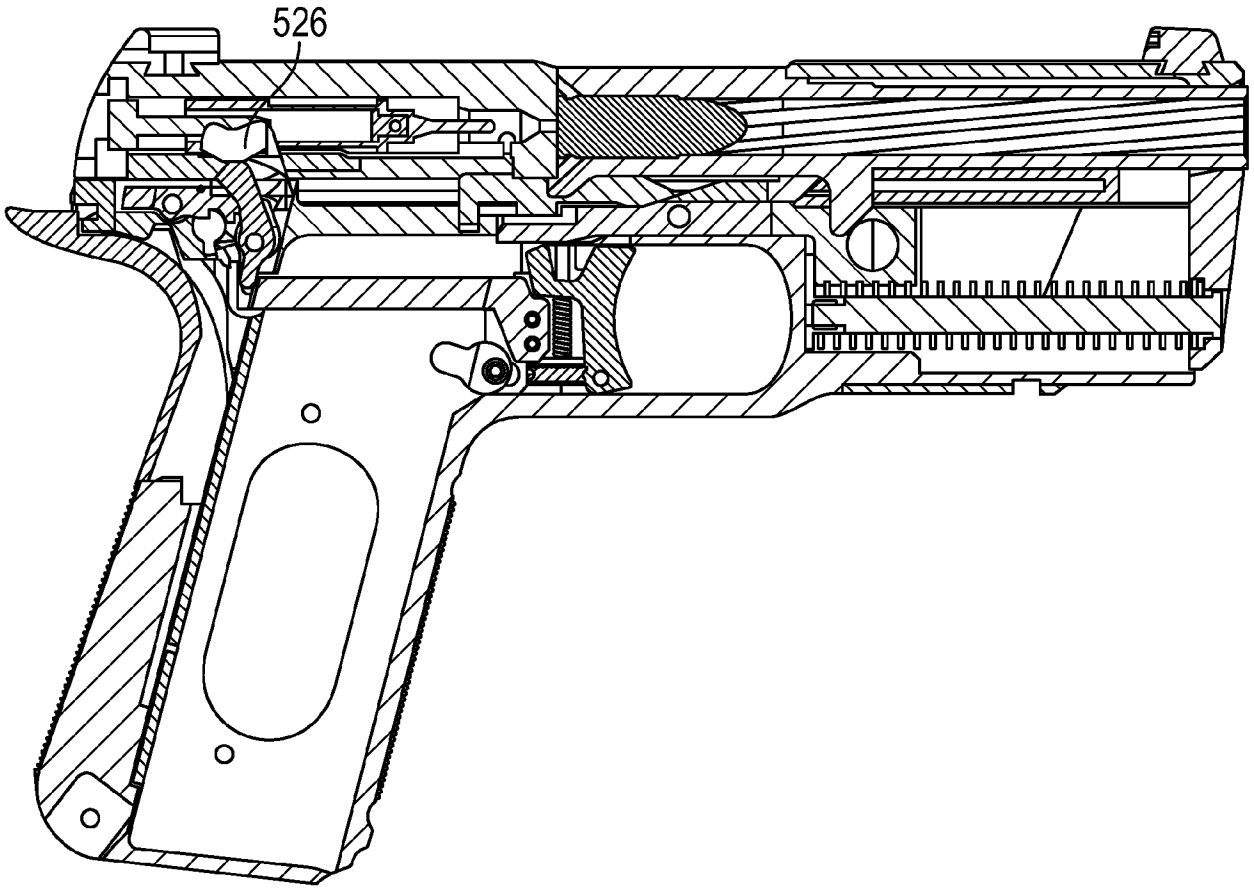
FIG. 11 is a right side cross-sectional view of the firearm of FIG. 10, wherein the cross-section shows the striker block mechanism in break out view.

FIG. 1 is an exploded view perspective illustration of an exemplary embodiment of a sear mechanism of the present disclosure. Reference number 100 refers to the complete assembled sear mechanism which is illustrated in FIG. 1 in an exploded view. Sear chassis 102 has a proximate end 140 and a distal end 150. Sear chassis 102 holds, or has attached to it, the various components that combine to form sear mechanism 100. Sear block 104 is held in manifold sear housing 102 with first pin 126 through pin bore 126A (not visible due to an obstructing feature) and sear block pin bore 128B and sear bore 126C. Sear bias spring 108 biases sear 106 on to sear block 104. The proximate end of sear 106 provides a sear cam 220 feature adjacent to the proximate flat ledge 225 of the body of sear 106. Disconnector 112 is mounted in manifold sear housing 102 on the distal side of sear block 104 within slot 104A using pin 126 through pin bore 126A (bore not shown) and disconnector bore 112B. Disconnector 112 has a top cam 210 adjacent to the flat ledge 205 of disconnector 112 body, and a bottom cam. Striker block actuator 110 pivotally and selectively engages striker block 526 (FIG. 11). Ejector 130 is held in place by pin 128.

The drawings of the following section illustrate the various moving parts of a firearm having a sear mechanism of the present disclosure in various views during a typical firing sequence. The firearm is initially in battery position with safeties engaged and with a cartridge in the chamber. As the sequence progresses, the safeties are released and the trigger is pulled, discharging the bullet from the cartridge and ejecting the empty shell. Finally, the firearm returns to battery position.

Figure 2:
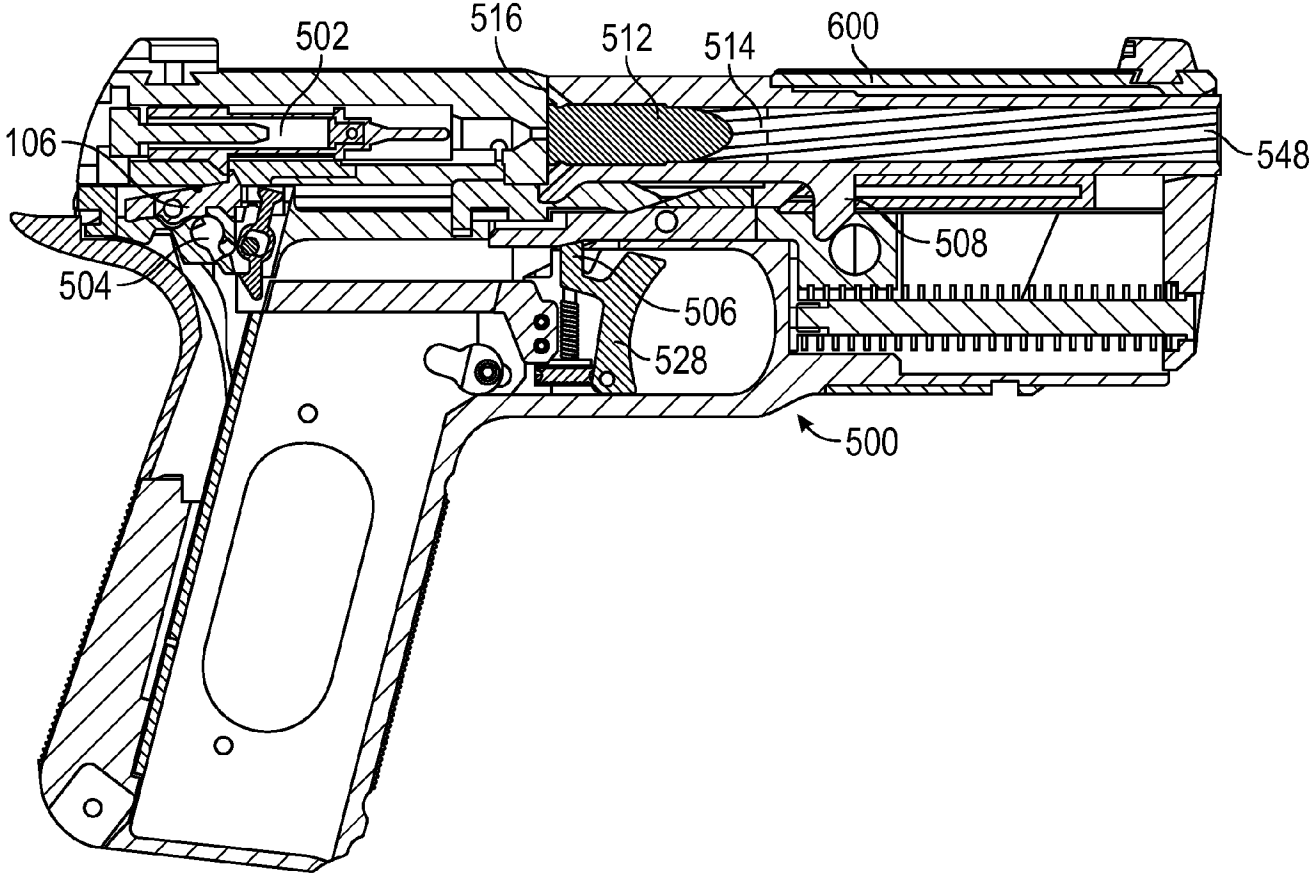
FIG. 2 is a right side cross-sectional view of a firearm having a sear mechanism of the present disclosure.

FIG. 2 is a right side cross-sectional view of a firearm having a sear mechanism of the present disclosure. Weapon 500 is at battery position with safeties engaged. Striker 502 is restrained by sear 106. Thumb safety 504 is engaged, disallowing sear block 104 from rotating in the clockwise direction. Trigger safety 506 is engaged. Barrel feature 508 is biased on a takedown pin. Cartridge 512 in chamber 514 is biased against and in contact with breach face 516 of slide 600.

Figure 3:
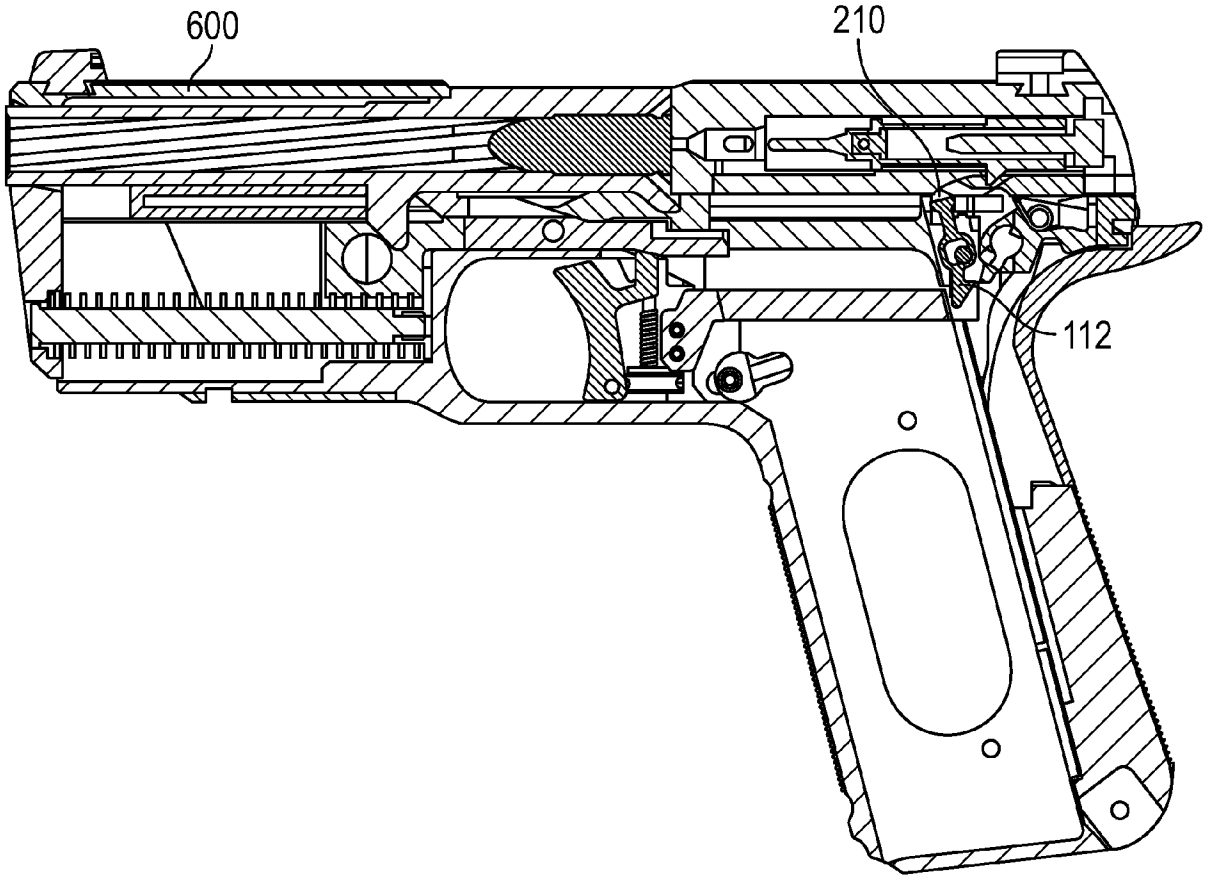
FIG. 3 is a left side cross-sectional view of the firearm of FIG. 2.

FIG. 3 is a left side cross-sectional view of the firearm of FIG. 2. Firearm 500 is at battery position with safety on. Disconnector cam 210 of disconnector 112 is engaged with a cam surface of slide 500.

Figure 4:
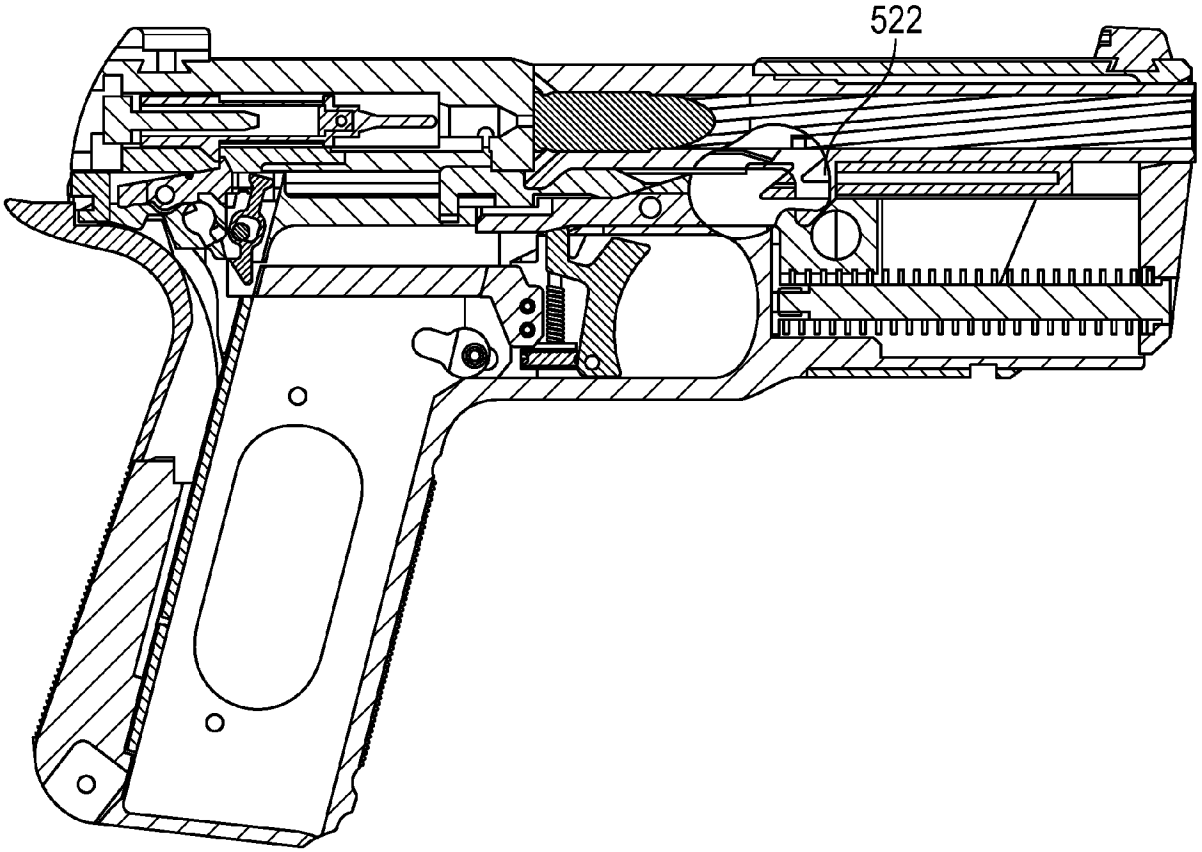
FIG. 4 is a right side cross-sectional view of the firearm of FIG. 2, wherein the cross-section shows the barrel lugs and cam mechanism in break out view.

FIG. 4 is a right side cross-sectional view of the firearm of FIG. 2, wherein the cross-section shows the barrel lugs and cam mechanism in break out view. Firearm 500 is at battery position with safety on. The barrel cam features of manifold sear housing 102 are not engaged with the barrel lugs 522 at this time.

Figure 5:
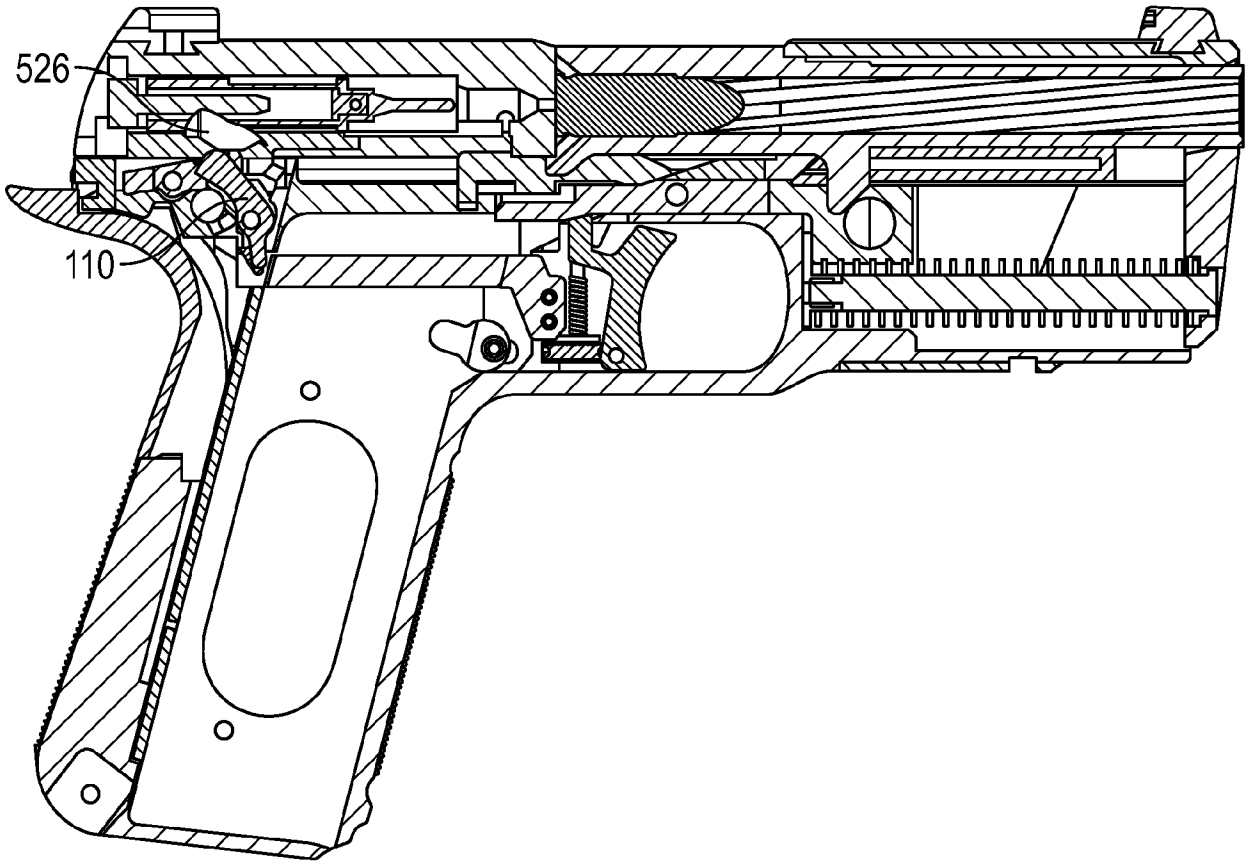
FIG. 5 is a right side cross-sectional view of the firearm of FIG. 2, wherein the cross-section shows the striker block mechanism in break out view.

FIG. 5 is a right side cross-sectional view of the firearm of FIG. 2, wherein the cross-section shows the striker block mechanism in break out view. A Striker block located within slide 600 prevents the striker from moving towards the primer in case of a drop shock or similar occurrence. Striker block 526 is disposed above and engaged with striker block actuator 110. Sear block 104 physically holds sear 106 in place. A thumb safety 504 and a trigger safety 506 are engaged.

Figure 6A:
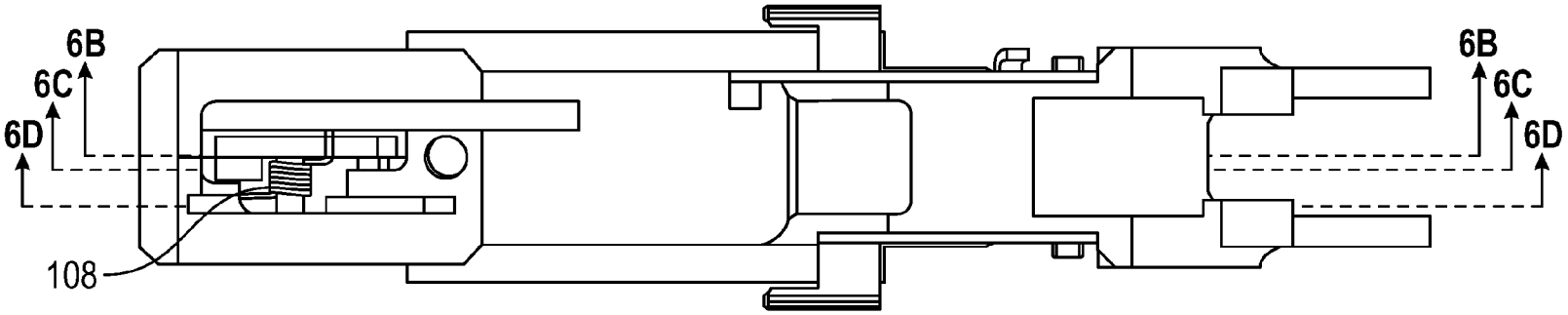
FIG. 6A is a top view schematic illustration of a firearm in battery, ready to fire, and having a sear mechanism of the present invention. Section lines A-A, B-B, and C-C are shown in side cross-section in FIGS. 6B, 6C, and 6D, respectively.

FIG. 6A is a top view cross-section schematic illustration corresponding to the firing state of FIGS. 2-5 of a firearm in battery, ready to fire, and having a sear mechanism of the present invention. Sear bias spring 108 is identified to help orient the reader. Section lines A-A, B-B, and C-C are shown in side cross-section in FIGS. 6B, 6C, and 6D, respectively.

Figure 6B:
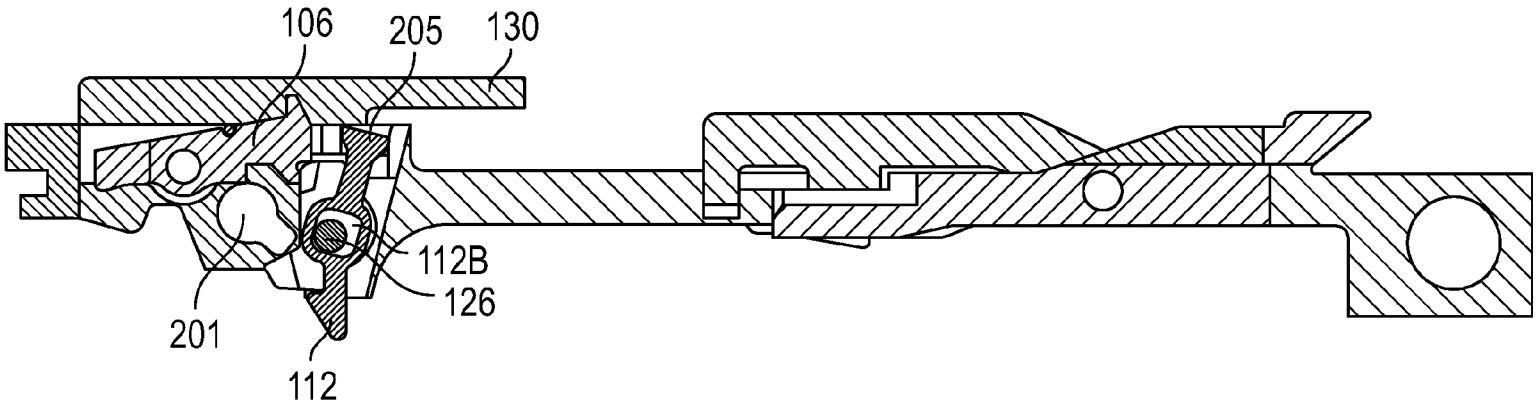
FIG. 6B is a side cross-section of the firearm of FIG. 2A along section line A-A.

FIG. 6B is a side cross-section of FIG. 6A along section line A-A. To explain the orientation of the various parts for the purposes of description, reference number 201 indicates a receptacle bore that receives a safety mechanism 504 inserted from the exterior housing of the firearm. Sear 106 is biased against and constrained by sear block 104 (see, FIG. 6C). Disconnector 112 is housed in slot 104A of sear block 104. Flat portion 205 of disconnector 112 is visible. Note the position of pin 126 housed in disconnector bore 112B in the lower left corner. As the trigger pull sequence progresses and sear block 104 rotates in the sear block manifold housing 102, note that the disconnector bore 112B moves in relation to pin 126. Safety connection receptacle 201 is a through hole feature within manifold sear housing 102 and is in a fixed position during the trigger pull sequence and also serves as a point of reference to understand the movement of the various parts.

Figure 6C:
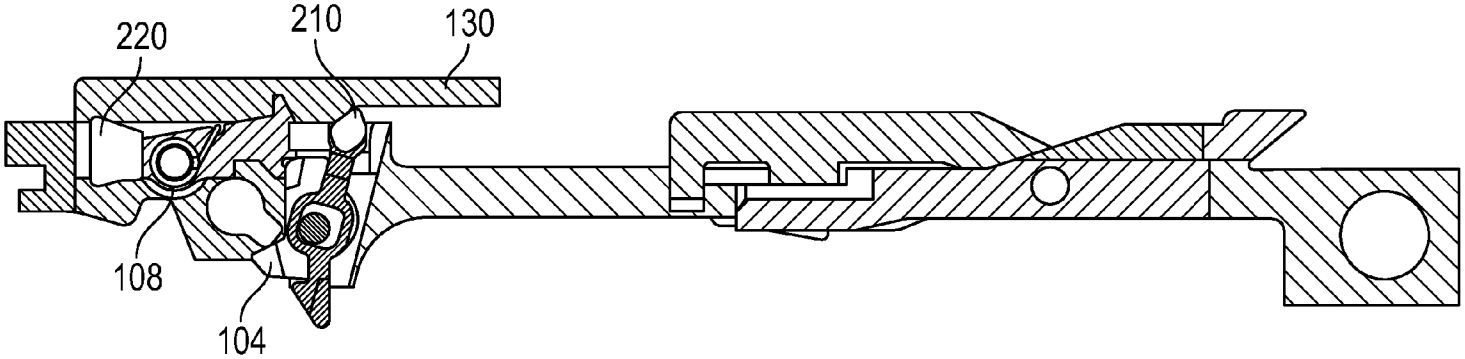
FIG. 6C is a side view cross-section of the firearm of FIG. 2A along section line B-B.

FIG. 6C is a side view cross-section of the FIG. 6A along section line B-B. Disconnector cam 210, which extends upwards from ledge 205, is visible in this section.

Figure 6D:
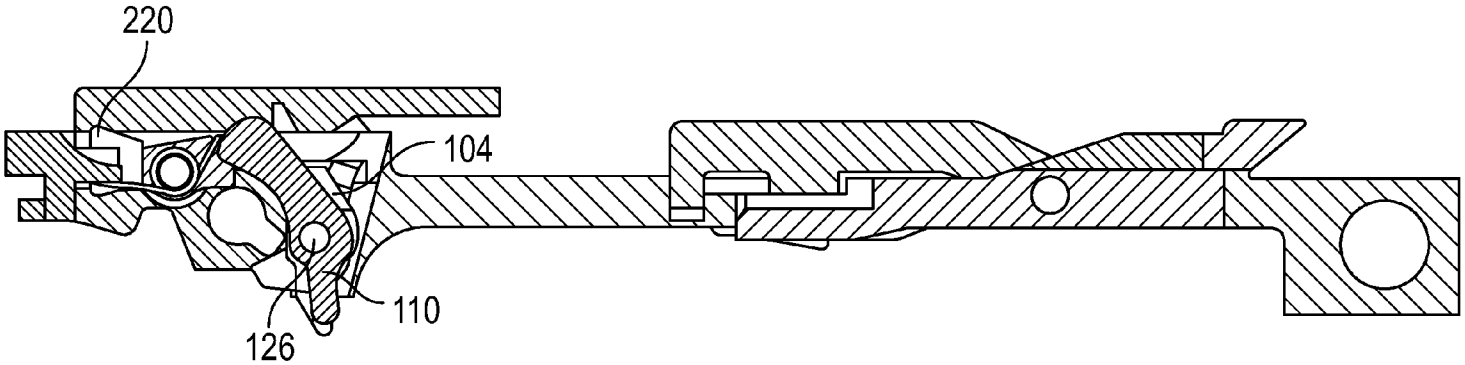
FIG. 6D is a side view cross-section of the firearm of FIG. 2A along section line C-C.

FIG. 6D is a side view cross-section of FIG. 6A along section line C-C. In this cross-section, striker block actuator 110 is visible.

Figure 7:
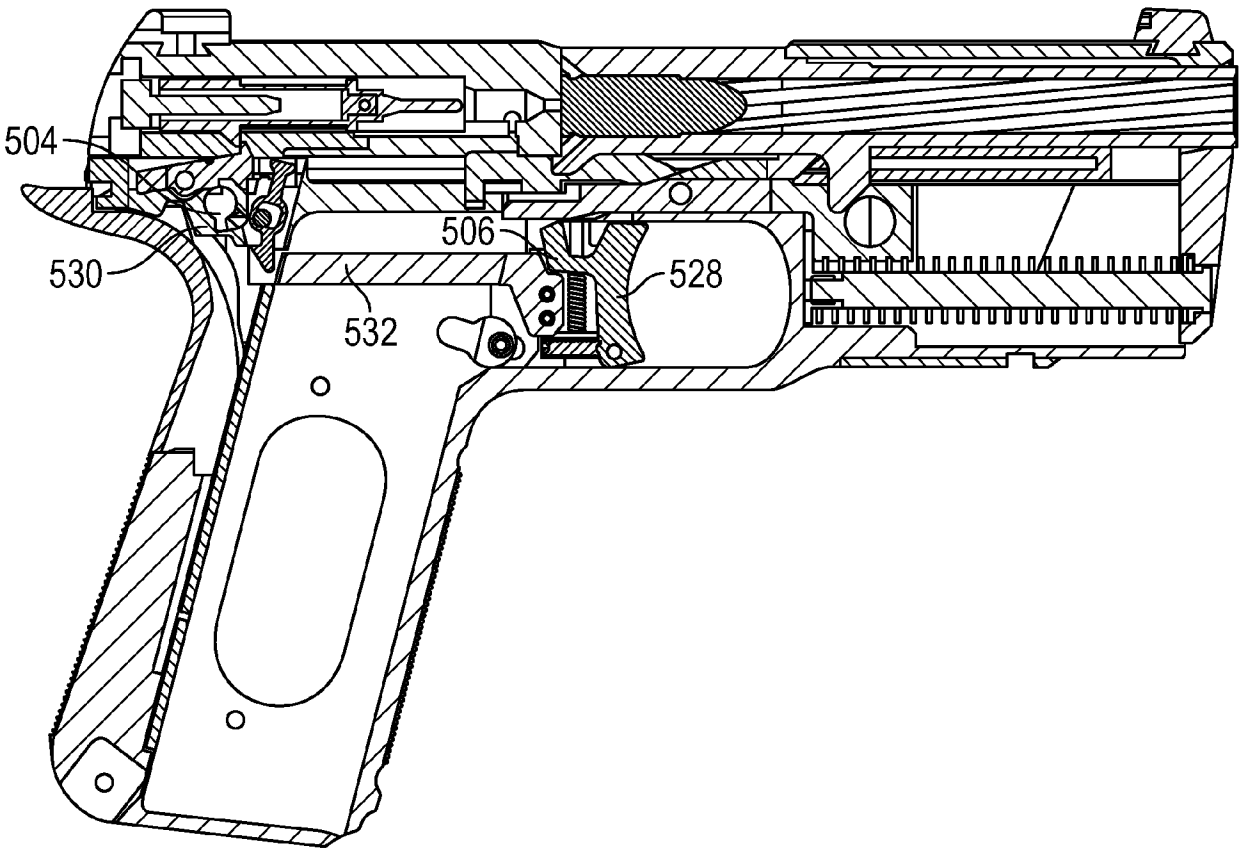
FIG. 7 is a right side cross-sectional view of a firearm of FIG. 2, wherein the trigger pull has begun.

FIG. 7 is a right side cross-sectional view of a firearm of FIG. 2, wherein the trigger pull has begun. Thumb safety 504 is disengaged. Trigger safety 506 is disengaged. Fire control assembly 530, which includes sear block 104, disconnector 112 and striker block actuator 110, is rotating clockwise. Trigger yoke 532 of trigger assembly 528 is translating horizontally relative to the proximate end of firearm 500, causing assembly 530 to rotate relative to pin 126.

Figure 8:
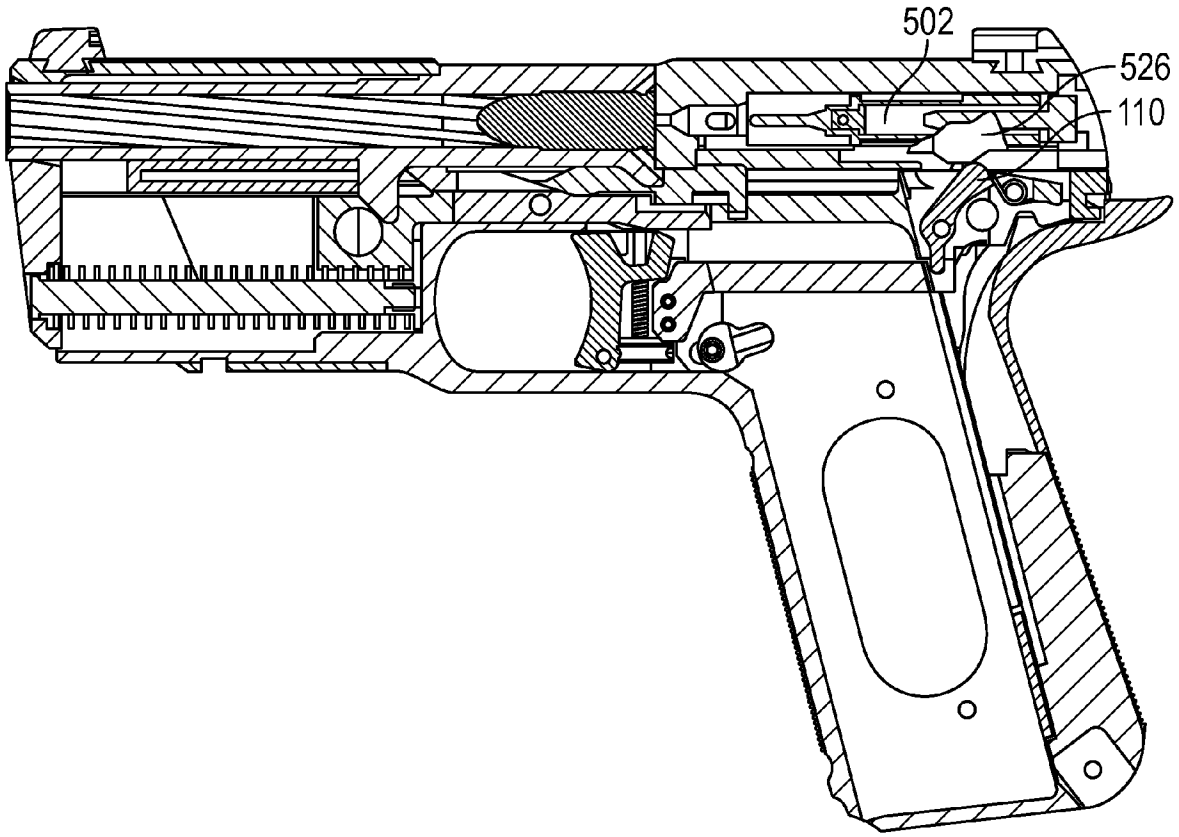
FIG. 8 is a left side cross-sectional view of the firearm of FIG. 7, wherein the cross-section shows the striker block mechanism in break out view.

FIG. 8 is a left side cross-sectional view of the firearm of FIG. 7. Trigger 528 pull has begun. Striker block 526 is being lifted by the rotation of striker block actuator 110.

Figure 9A:
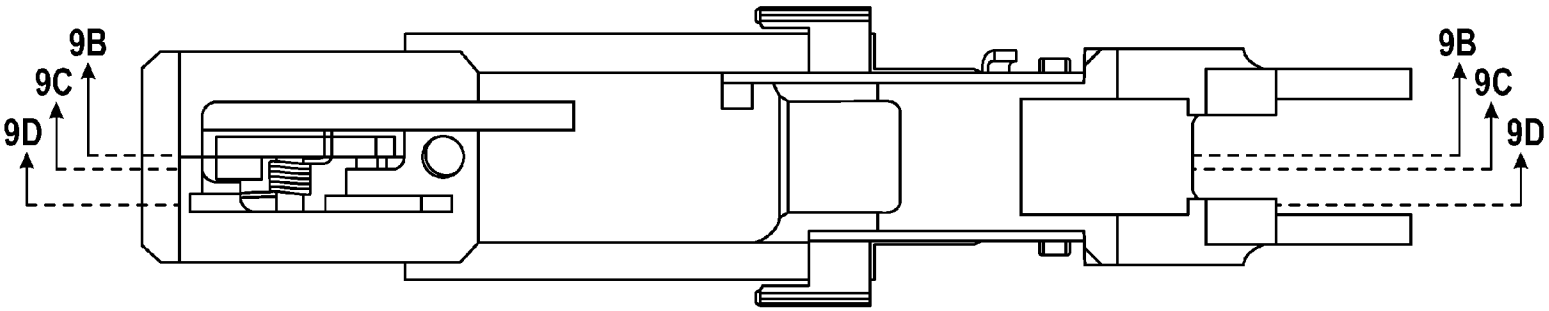
FIG. 9A is a top view schematic illustration of a firearm having a sear mechanism of the present invention. Section lines A-A, B-B, and C-C are shown in side cross-section in FIGS. 9B, 9C, and 8D, respectively.

FIG. 9A is a top view schematic illustration of a firearm of FIGS. 7 and 8. The firearm is at the beginning of trigger pull. Section lines A-A, B-B, and C-C are shown in side cross-section in FIGS. 9B, 9C, and 9D, respectively.

Figure 9B:
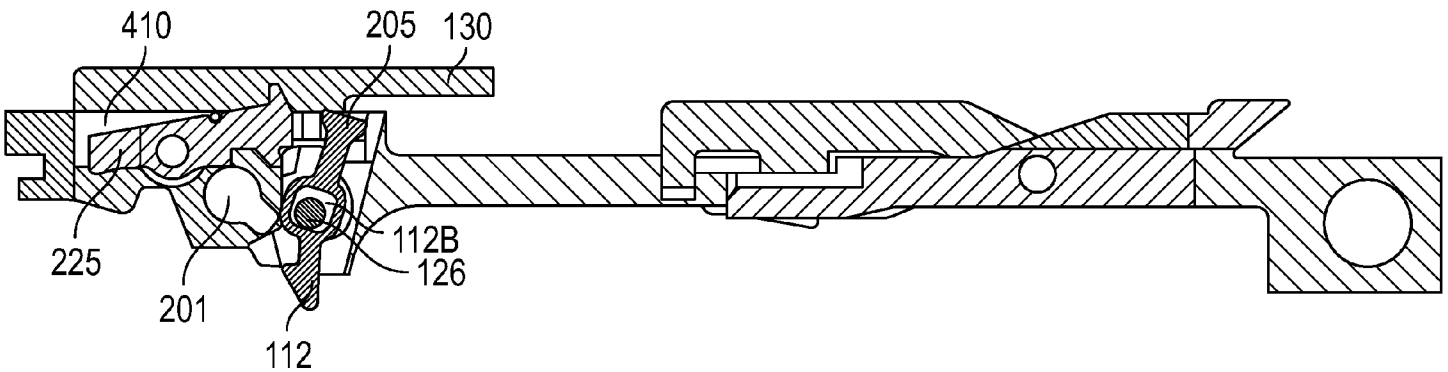
FIG. 9B is a side cross-section of the firearm of FIG. 9A along section line A-A.

FIG. 9B is a side cross-section of FIG. 9A along section line A-A. As disconnector 112 rotates clockwise, the position of the disconnector bore 112B relative to pin 126 changes. Gap 410 above sear ledge 225 will change as the firing sequence progresses, when sear 106 is clear of sear block 104.

Figure 9C:
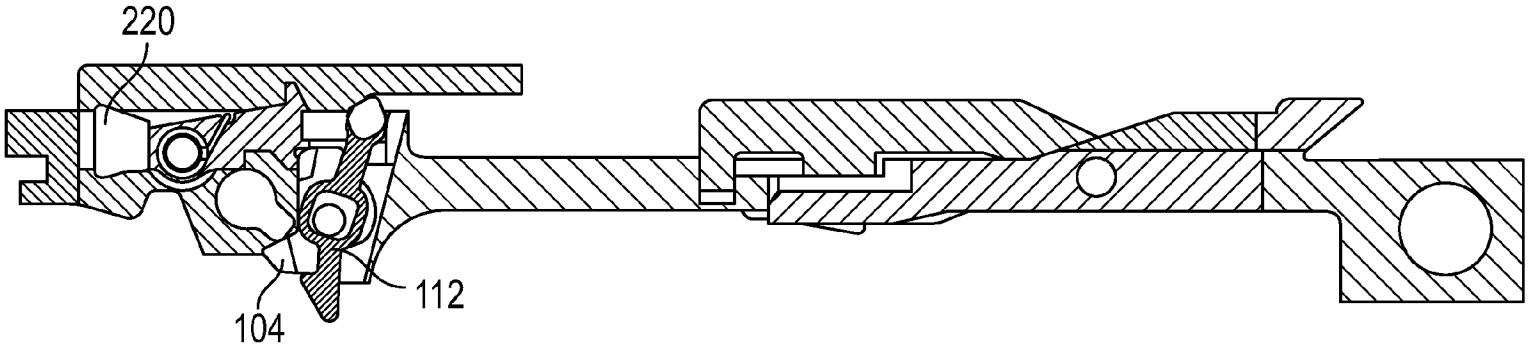
FIG. 9C is a side view cross-section of the firearm of FIG. 9A along section line B-B.

FIG. 9C is a side view cross-section of FIG. 9A along section line B-B. Sear block 104 will begin to rotate as disconnector 112 selectively and operably engages. Sear 106 will drop after sear block 104 has rotated free of sear 106. Sear cam 220 is visible in this view.

Figure 9D:
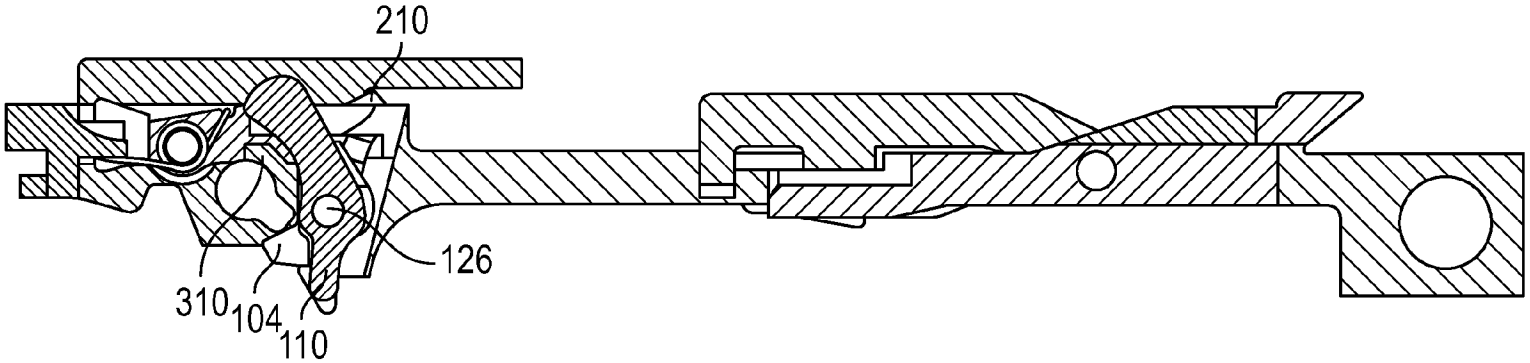
FIG. 9D is a side view cross-section of the firearm of FIG. 9A along section line C-C.

FIG. 9D is a side view cross-section of FIG. 9A along section line C-C. Striker block actuator 110 is rotating clockwise as the trigger is pulled.

As the firing sequence progresses, trigger pull safety 506 (FIGS. 2 and 7) is disengaged. As the trigger assembly 528 moves rearward, the trigger yoke 532 engages disconnector 112 bottom cam and the striker block actuator 110 within the fire control assembly 530.

Figure 10:
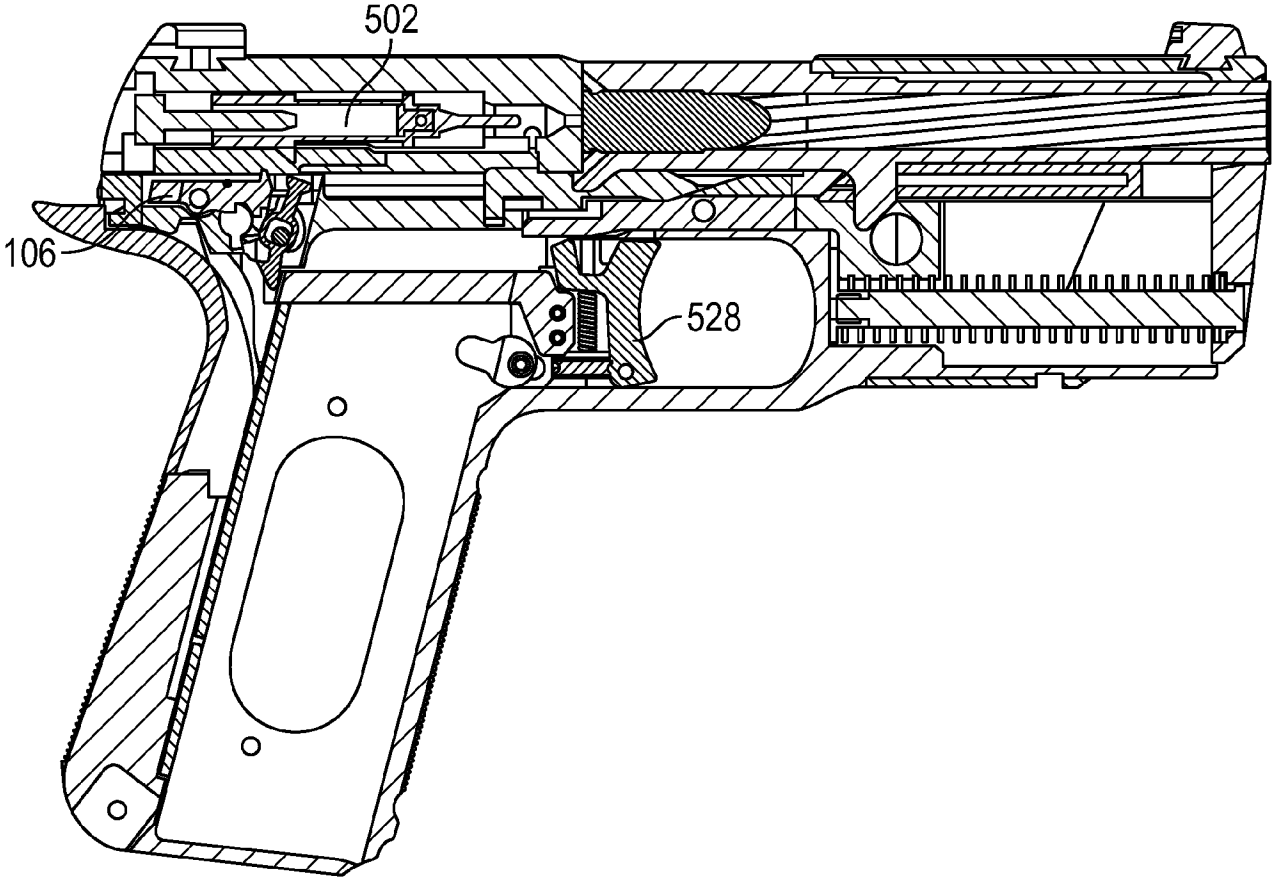
FIG. 10 is a right side cross-sectional view of a firearm of the present disclosure, wherein trigger pull is continuing from the position of FIGS. 7 and 8.

FIG. 10 is a right side cross-sectional view of a firearm of the present disclosure, wherein trigger pull is continuing from the position of FIGS. 7 and 8. Trigger assembly 528 is fully actuated. Sear 106 has fallen to release striker 502. Striker 502 is moving forward toward the distal end of the weapon to ignite the primer of cartridge 512.

FIG. 11 is a right side cross-sectional view of the firearm of FIG. 10, wherein the cross-section shows the striker block mechanism in break out view. Striker block 526 is disengaged to release striker 502 to ignite the primer and expel round 512 from casing 540.

Figure 12:
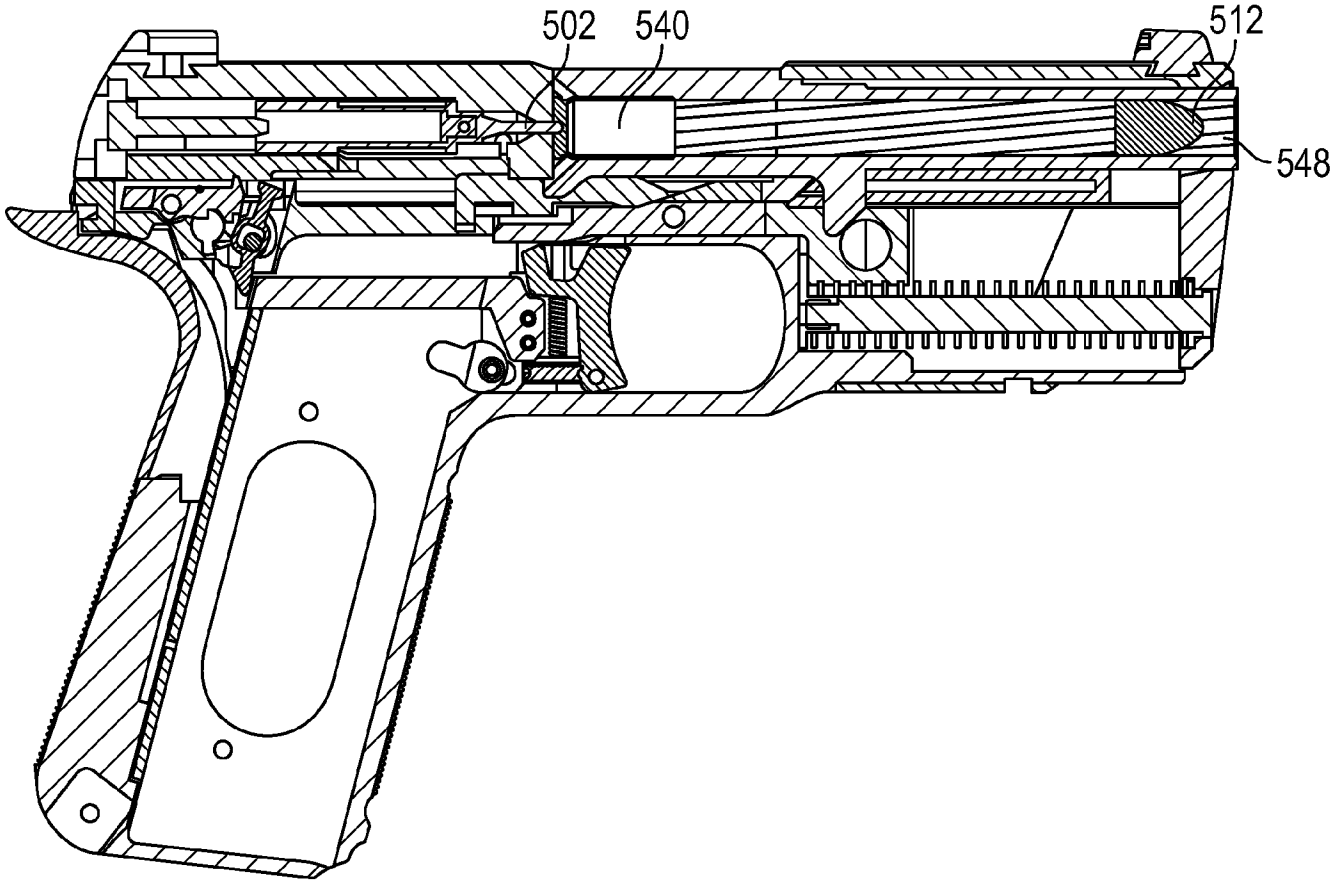
FIG. 12 is a right side cross-sectional view of a firearm of the present disclosure, wherein a round is leaving the barrel.

FIG. 12 is a right side cross-sectional view of a firearm of the present disclosure, wherein a bullet is leaving the barrel. Striker 502 ignites the primer and expels bullet 512 from barrel 548. Empty casing 540 remains in the chamber near breach face 516 of slide 600.

Figure 13A:
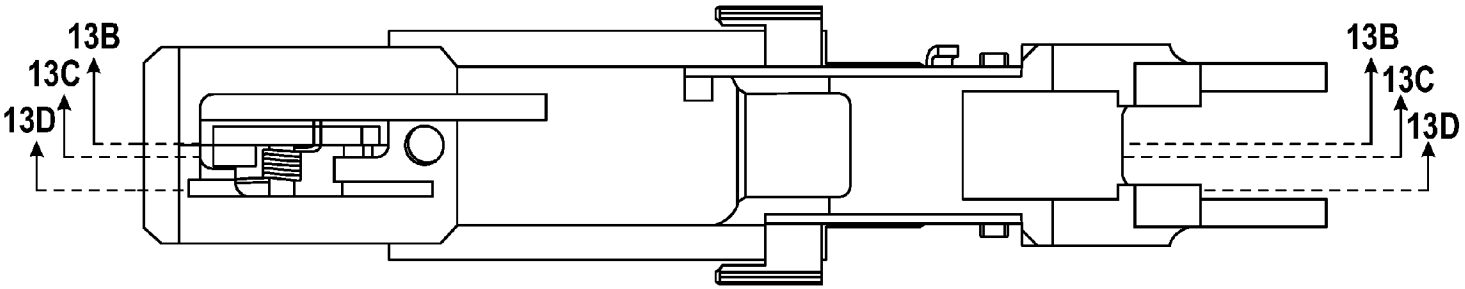
FIG. 13A is a top view schematic illustration of a firearm having a sear mechanism of the present invention. Section lines A-A, B-B, and C-C are shown in side cross-section in FIGS. 13B, 13C, and 13D, respectively.

The description of the trigger pull sequence now shifts out of sequence with FIG. 13A-D to illustrate a transitional position. The transitional position of FIGS. 13A-D occurs between the firing positions of FIGS. 9A-D and FIG. 10, but is useful to describe here before continuing with the ordinary firing sequence. Accordingly, FIG. 13A is a top view schematic cross section illustration of a firearm in transition between FIG. 7 and FIGS. 10, 11 and 12. Section lines A-A, B-B, and C-C are shown in side cross-section in FIGS. 13B, 13C, and 13D, respectively.

Figure 13B:
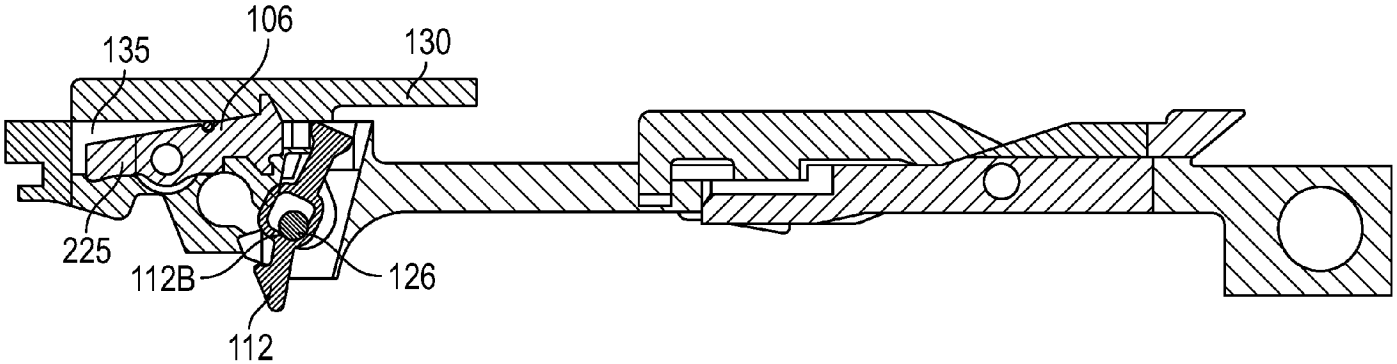
FIG. 13B is a side cross-section of the firearm of FIG. 13A along section line A-A.

FIG. 13B is a side cross-section of FIG. 13A along section line A-A. Disconnector bore 112B has shifted position relative to pin 126 to the lower right corner as sear block 104 rotates clockwise, as shown in subsequent figures.

Figure 13C:
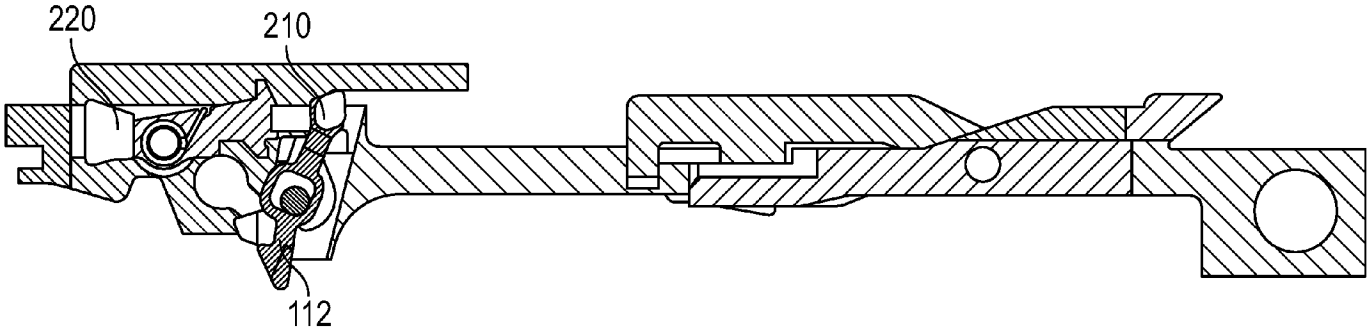
FIG. 13C is a side view cross-section of the firearm of FIG. 13A along section line B-B.

FIG. 13C is a side view cross-section of FIG. 13A along section line B-B. Disconnector cam 210 and sear cam 220 are visible in this cross-section.

Figure 13D:
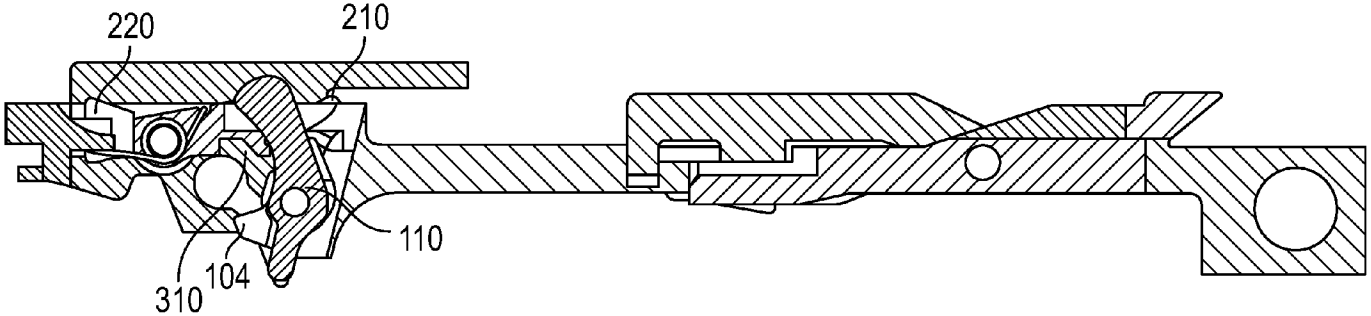
FIG. 13D is a side view cross-section of the firearm of FIG. 13A along section line C-C.

FIG. 13D is a side view cross-section of the firearm of FIG. 12A along section line C-C. Striker block actuator 110 is rotating clockwise as the trigger is pulled, which rotation results in a widening of gap 310 to its maximum.

Figure 14:
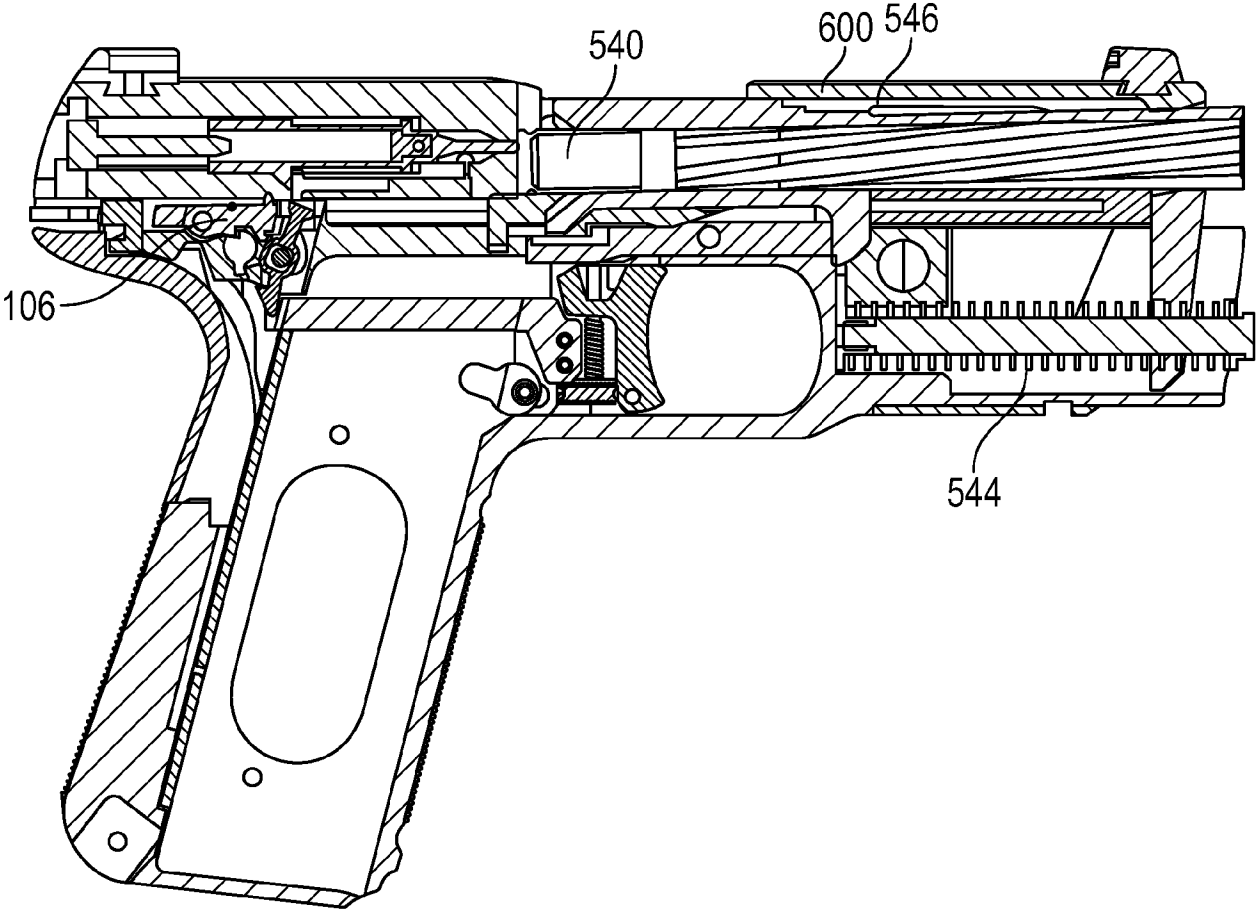
FIG. 14 is a right side cross-sectional view of a firearm of the present disclosure, wherein the firearm is beginning to cycle after expelling a round.

Returning to the firing sequence from FIG. 12, FIG. 14 is a right side cross-sectional view of a firearm of the present disclosure, wherein the firearm is beginning to cycle after expelling a bullet. Barrel hood 546 has dropped below slide 600. Slide 600 is traversing to the rear. Sear 106 is down. Empty casing 540 remains in the chamber. Recoil spring 544 is beginning compression backward.

Figure 15:
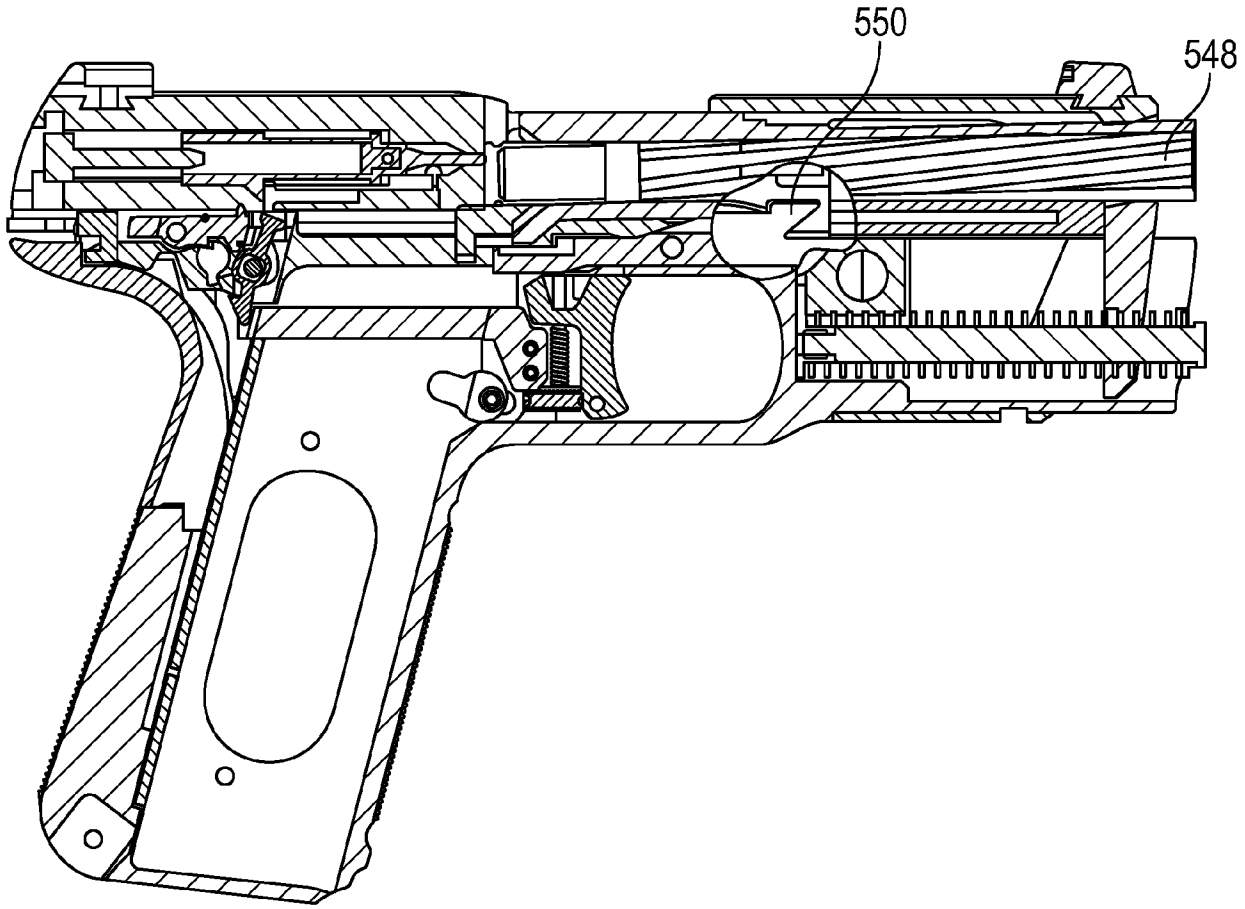
FIG. 15 is a right side cross-sectional view of the firearm of FIG. 14, wherein the cross-section shows the barrel lugs and cam mechanism in break out view.

FIG. 15 is a right side cross-sectional view of the firearm of FIG. 14 with a cam break out detail. The lugs of Barrel 548 are engaged with the cam features 550 of manifold sear housing 102.

Figure 16:
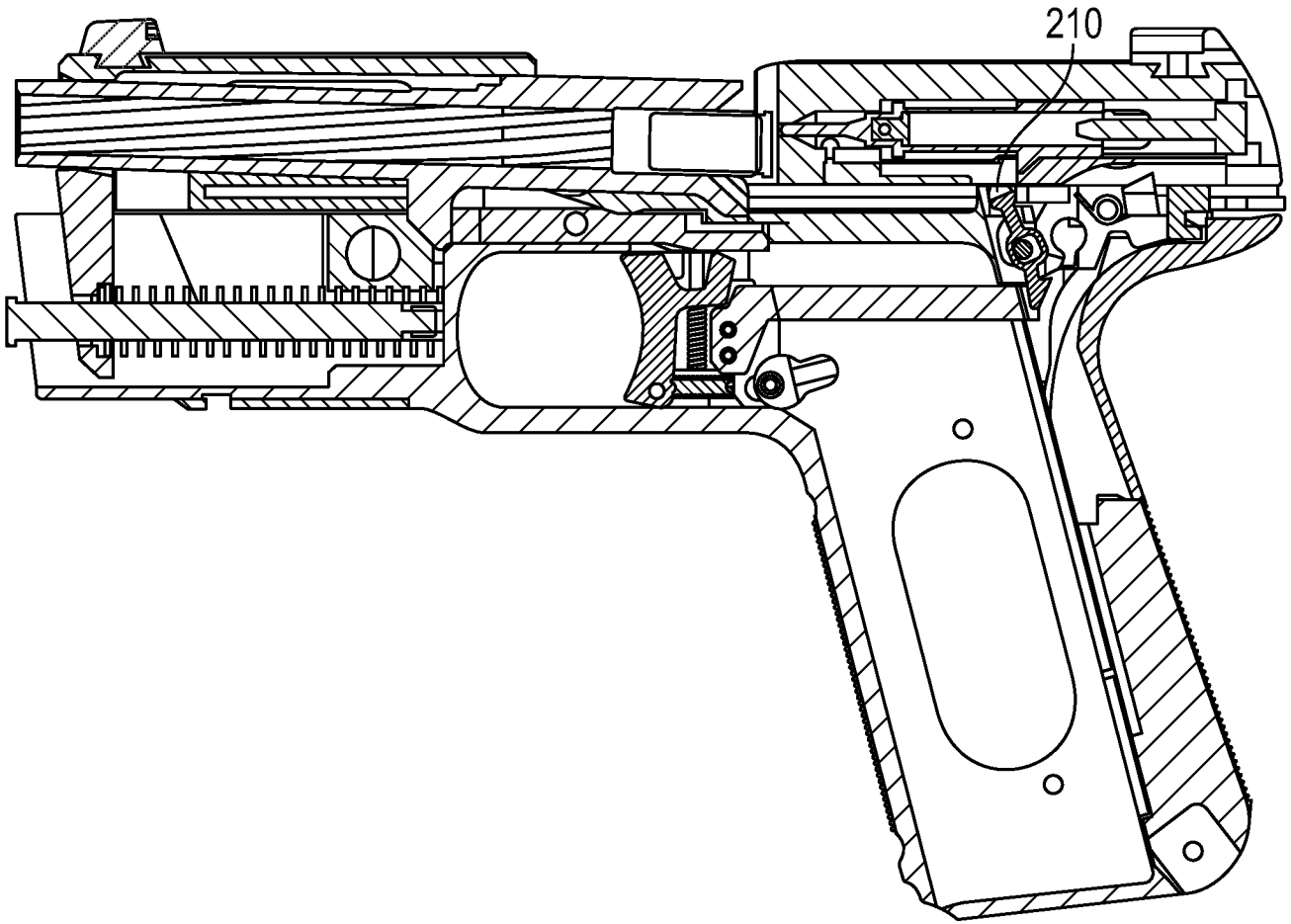
FIG. 16 is a left side cross-sectional view of the firearm of FIG. 14.

FIG. 16 is a left side cross-sectional view of the firearm of FIG. 15. Disconnector 112 is pushed down by a cam on slide 600.

Figure 17A:
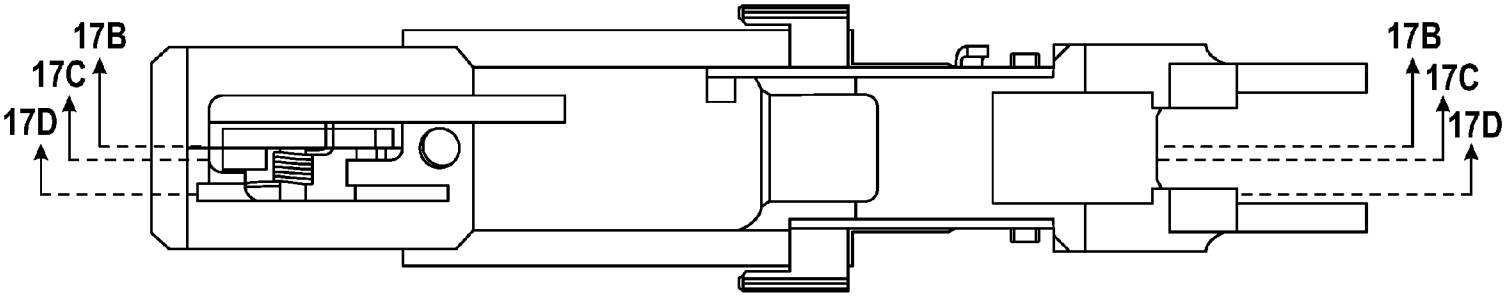
FIG. 17A is a top view schematic illustration of a firearm having a sear mechanism of the present invention. Section lines A-A, B-B, and C-C are shown in side cross-section in FIGS. 17B, 17C, and 17D, respectively.

FIG. 17A is a top view schematic illustration of a firearm of FIG. 16 having a sear mechanism of the present invention. Section lines A-A, B-B, and C-C are shown in side cross-section in FIGS. 17B, 17C, and 17D, respectively.

Figure 17B:
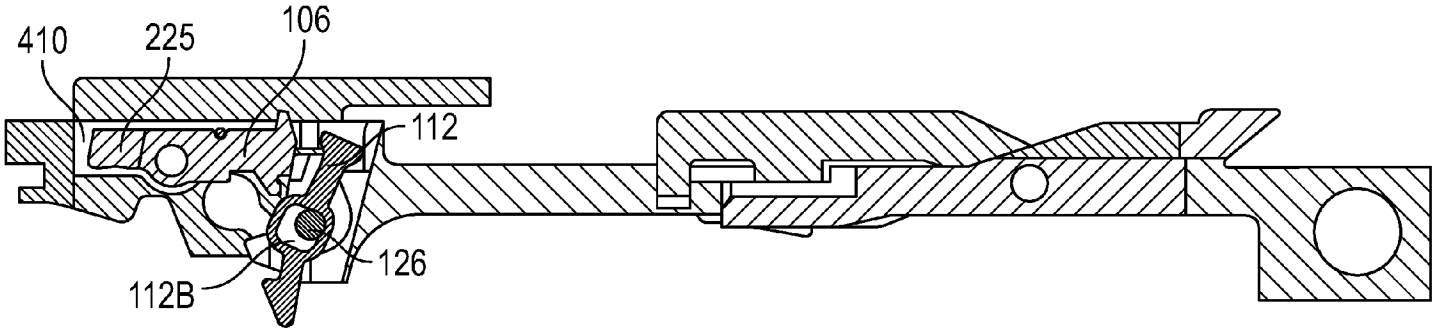
FIG. 17B is a side cross-section of the firearm of FIG. 17A along section line A-A.

FIG. 17B is a side cross-section of FIG. 17A along section line A-A. Angle 410, as in previous corresponding views, is discernable between sear 106 proximate end 205 and ejector 130 proximate end 135. Angle 410 is reduced in comparison with angle 410 in FIG. 9B. As the trigger pull continues, sear ledge 225 has rotated clockwise such that it is essentially parallel to ejector 130. The disconnector 112 has now dropped down such that pin 126 is shown in the upper right corner of disconnector bore 112B.

Figure 17C:
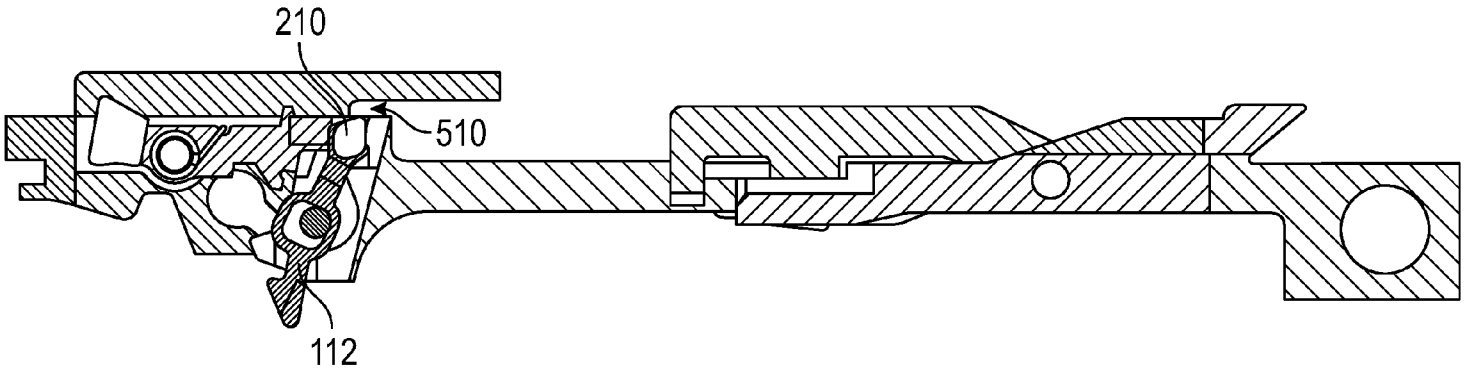
FIG. 17C is a side view cross-section of the firearm of FIG. 17A along section line B-B.

FIG. 17C is a side view cross-section of FIG. 17A along section line B-B. Disconnector cam 210 has translated downward, as may be observed in gap 510 between cam 210 and ejector 130. Gap 510 is not visible in FIGS. 2A-D-4A-D.

Figure 17D:
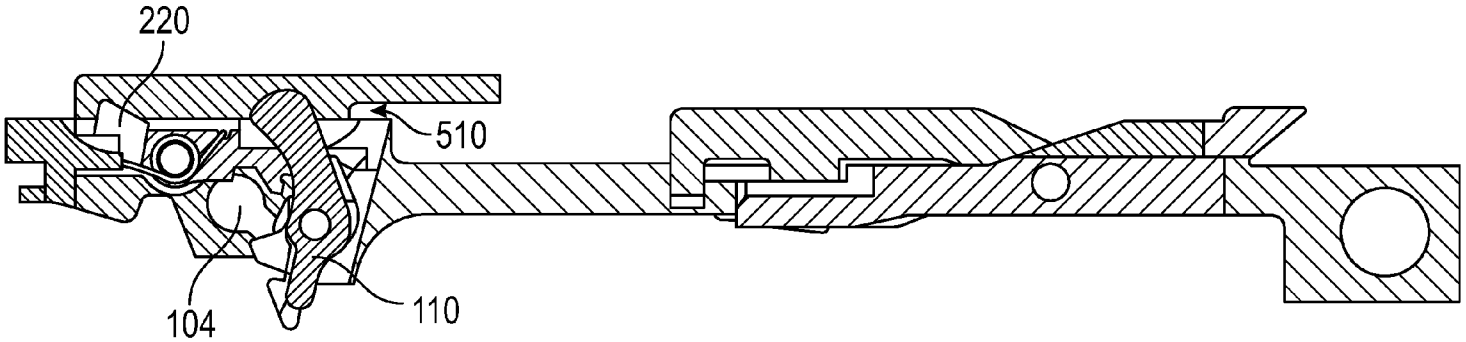
FIG. 17D is a side view cross-section of the firearm of FIG. 17A along section line C-C.

FIG. 17D is a side view cross-section of FIG. 17A along section line C-C. Sear block 104 is rotated clockwise, obscuring the thumb safety through hole 201.

Figure 18:
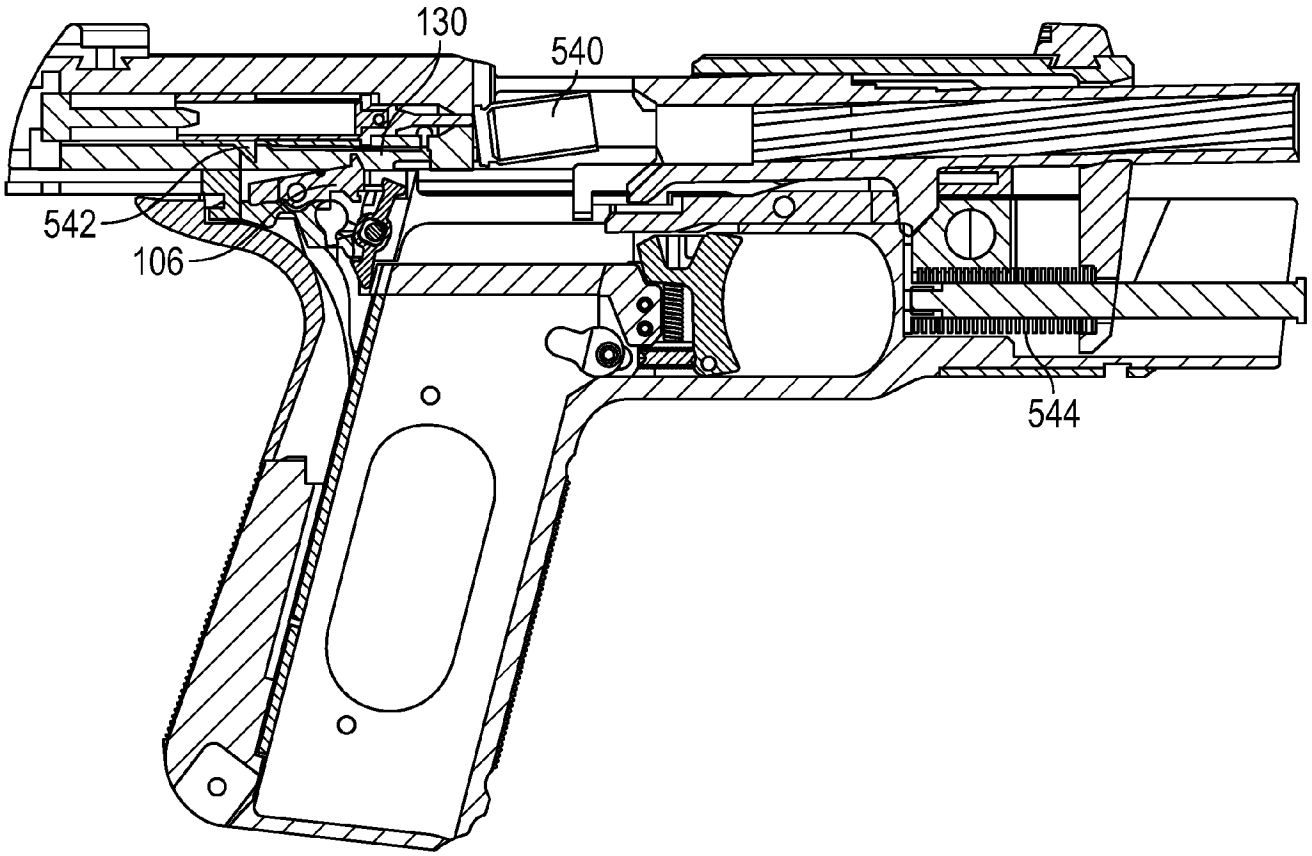
FIG. 18 is a right side cross-sectional view of a firearm of the present disclosure, wherein the firearm is in mid-cycle.

FIG. 18 is a right side cross-sectional view of a firearm of the present disclosure, wherein the firearm is in mid-cycle. Slide 600 continues to traverse rearward. Sear 106 is actuated by a cam on slide 600. Empty casing 540 hits ejector 130. Recoil spring 544 is in mid-compression.

Figure 19:
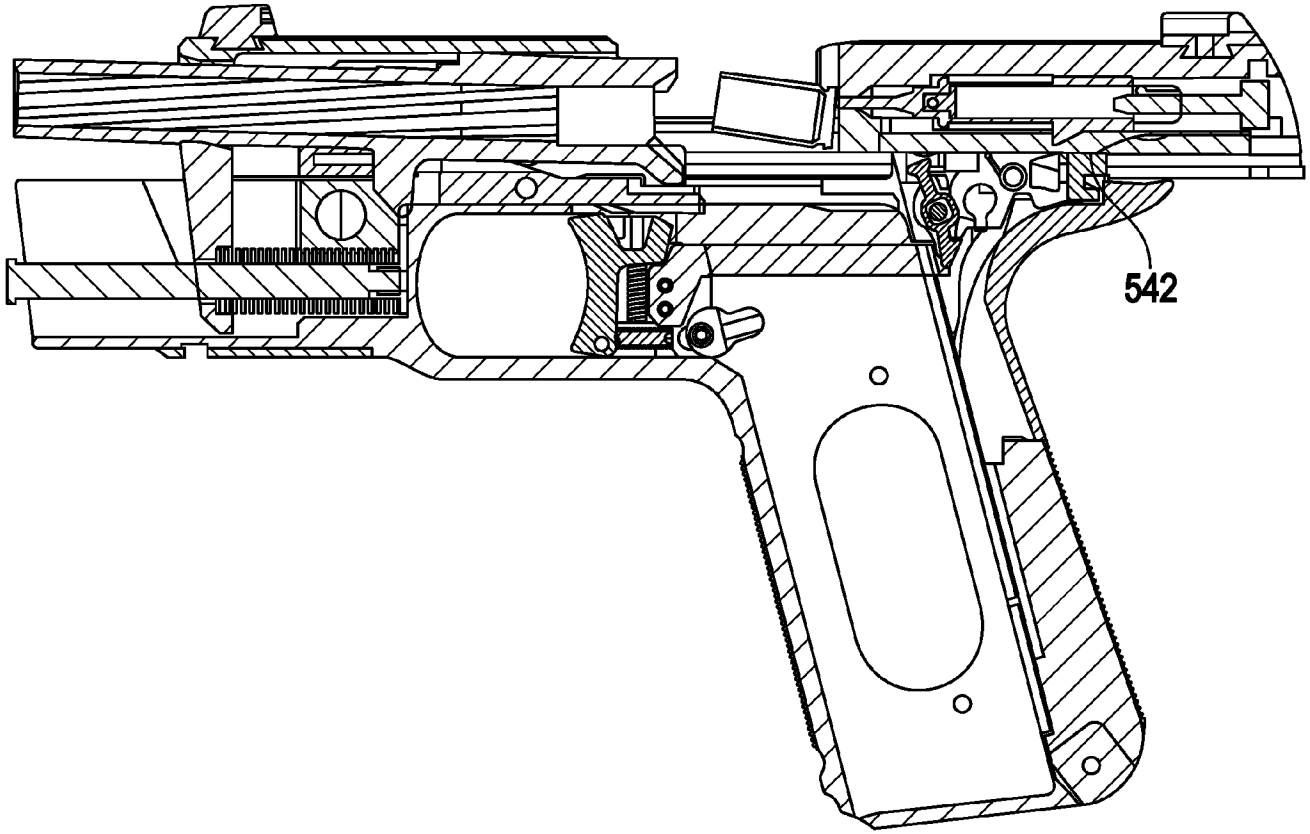
FIG. 19 is a left side cross-sectional view of the firearm of FIG. 18.
Figure 22:
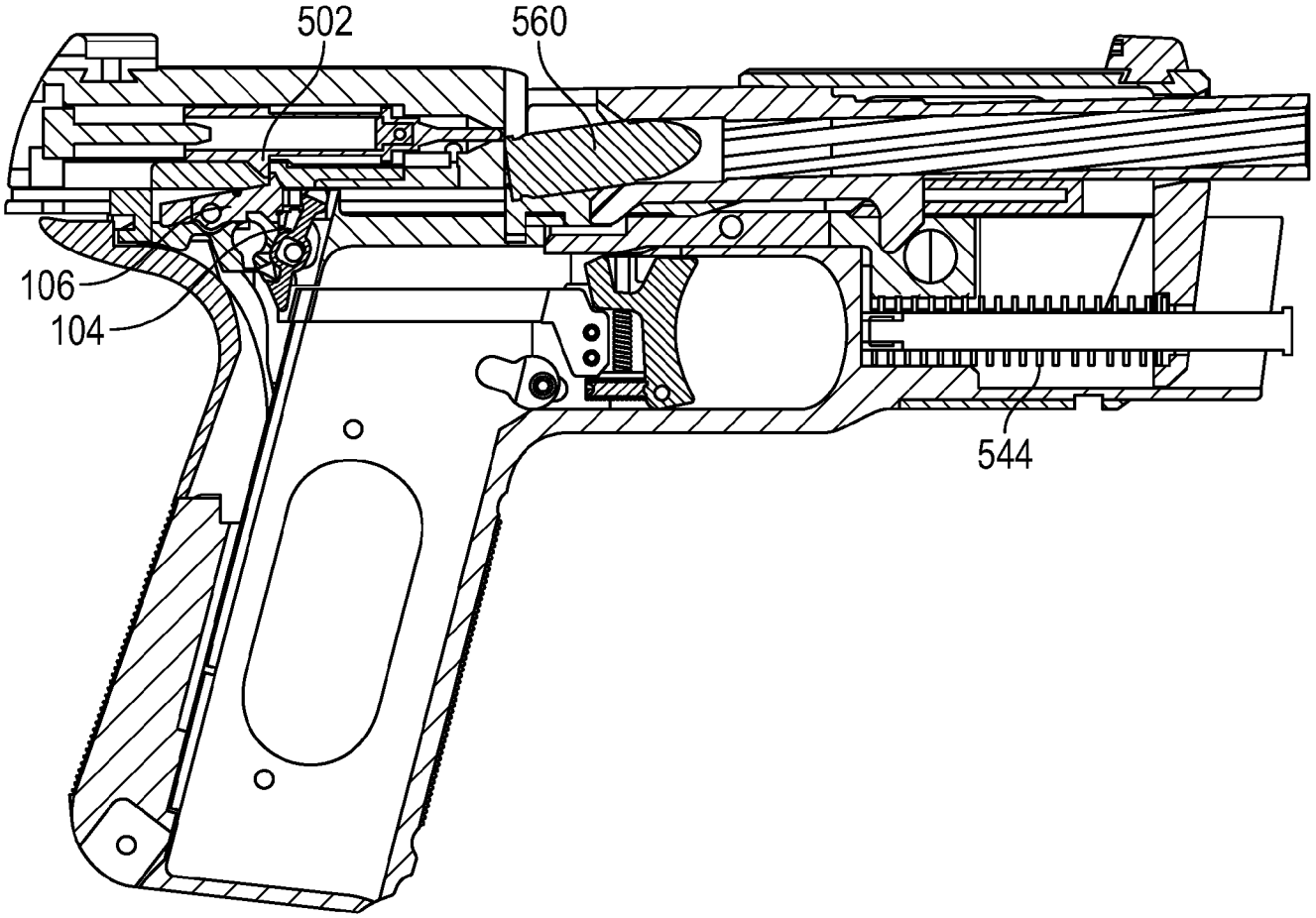
FIG. 22 is a right side cross-sectional view of a firearm of the present disclosure, wherein the slide is traveling back to battery position.

FIG. 19 is a left side cross-sectional view of the firearm of FIG. 22. Sear 106 is actuated by a cam 542 on slide 600, rotating it back to the initial position of FIG. 2 and out of the way of sear block 104.

Figure 20:
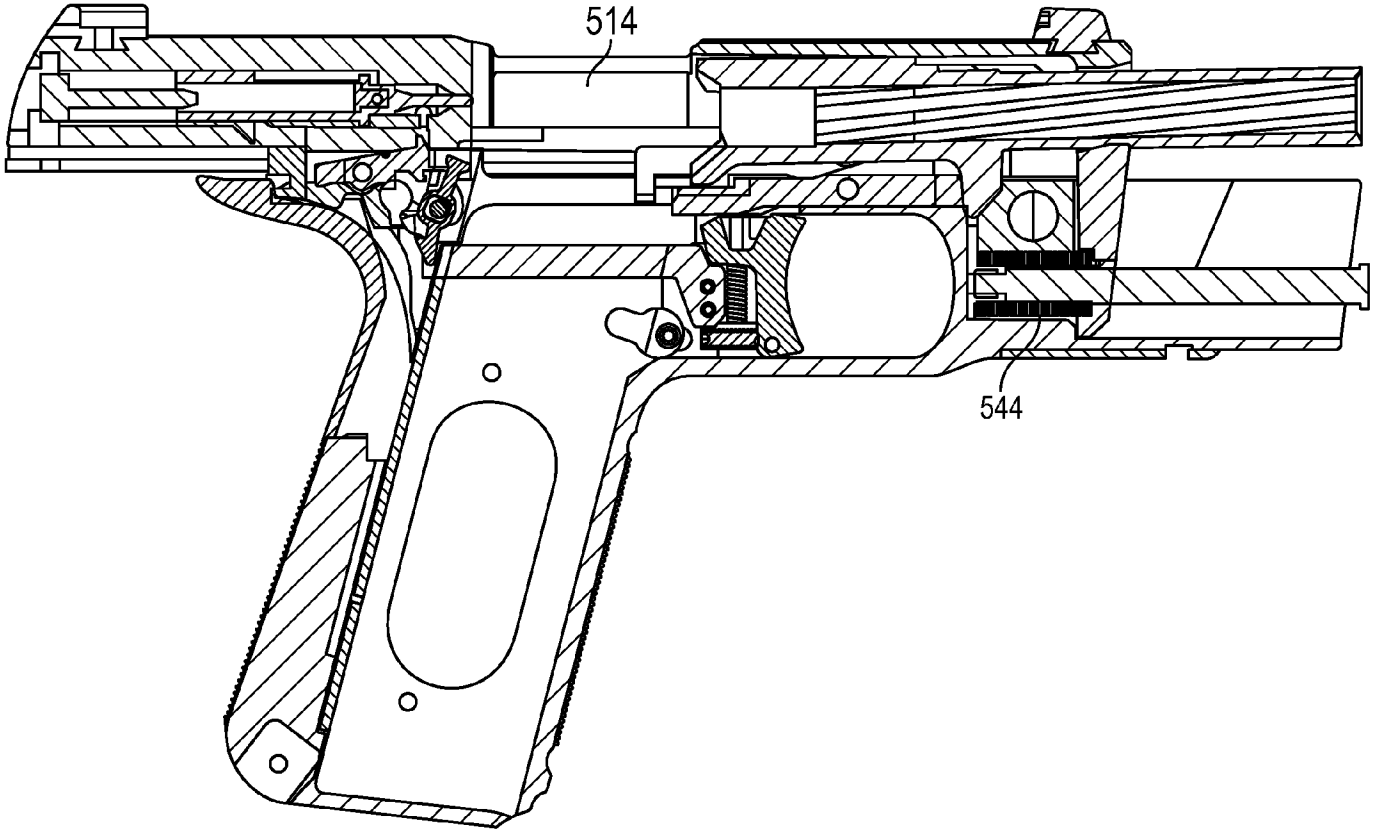
FIG. 20 is a right side cross-sectional view of a firearm of the present disclosure, wherein the slide is fully retracted.

FIG. 20 is a right side cross-sectional view of the firearm of FIG. 19, wherein the slide is fully retracted. Slide 600 is at maximum travel, fully retracted. Casing 540 has been ejected from the weapon. Recoil spring 544 is at maximum compression.

Figure 21A:
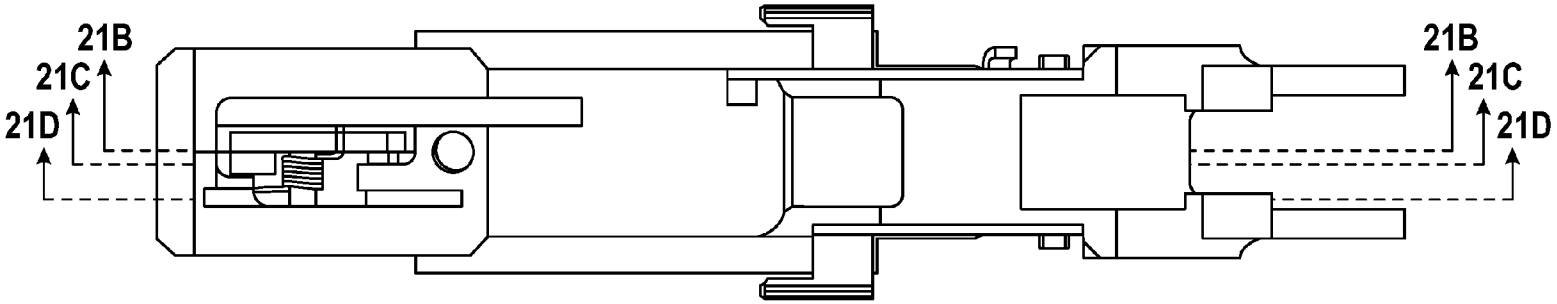
FIG. 21A is a top view schematic illustration of a firearm trigger pull in mid-cycle having a sear mechanism of the present invention. Section lines A-A, B-B, and C-C are shown in side cross-section in FIGS. 21B, 21C, and 21D, respectively.

FIG. 21A is a top view schematic illustration of a firearm of FIGS. 18-20 with trigger pull in mid-cycle and having a sear mechanism of the present invention. Section lines A-A, B-B, and C-C are shown in side cross-section in FIGS. 21B, 21C, and 21D, respectively.

Figure 21B:
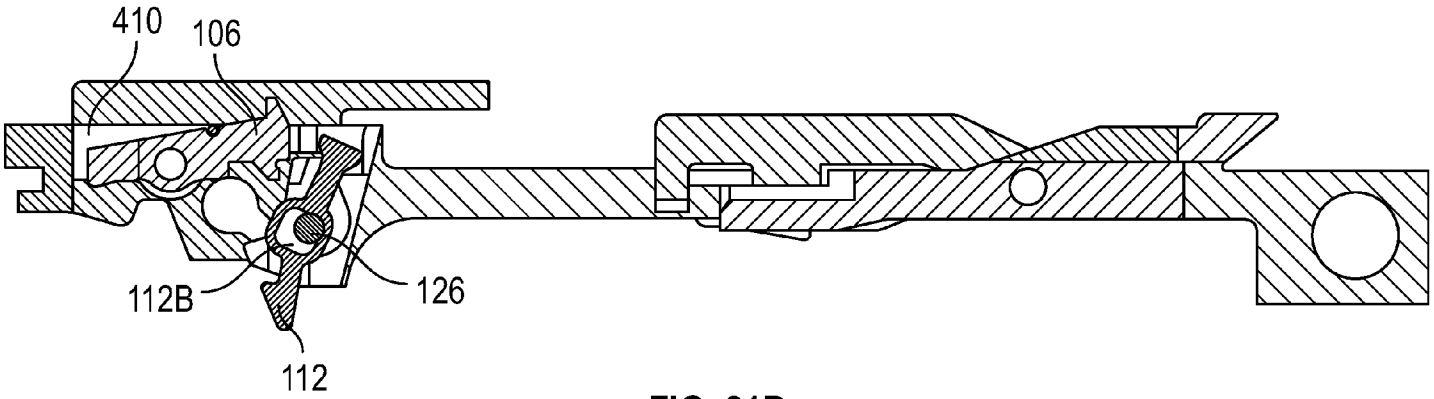
FIG. 21B is a side cross-section of the firearm of FIG. 21A along section line A-A.

FIG. 21B is a side cross-section of FIG. 21A along section line A-A. Cam 542 on the slide 600 has actuated sear 106 upwards (see the change in angle 410 from FIGS. 17A-D), which allows clearance for sear block 104 to rotate back into its initial position (FIG. 2).

Figure 21C:
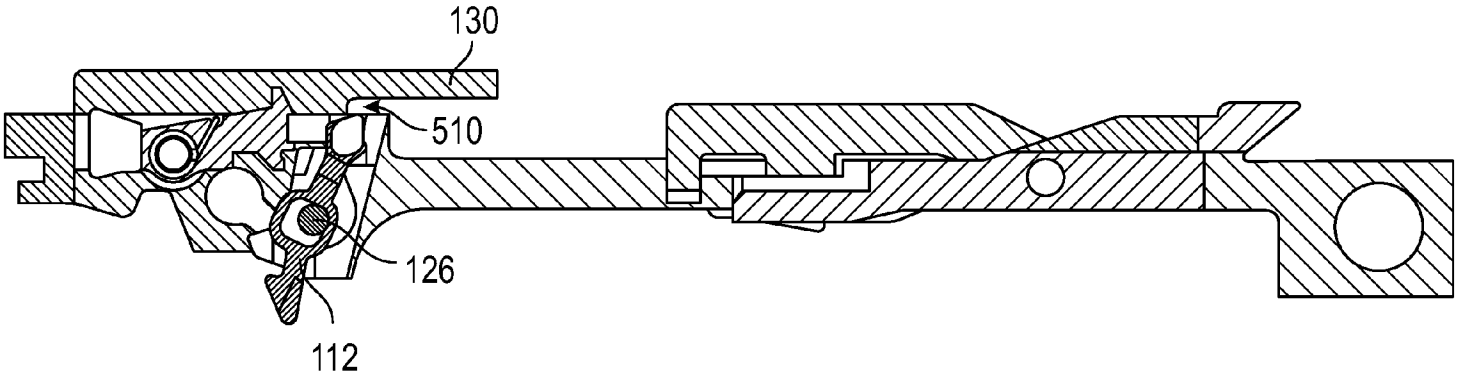
FIG. 21C is a side view cross-section of the firearm of FIG. 21A along section line B-B.

FIG. 21C is a side view cross-section of FIG. 21A along section line B-B. Disconnector 112 is activated and disengaged from sear block 104 allowing it rotate to its initial position as described below and shown in subsequent figures.

Figure 21D:
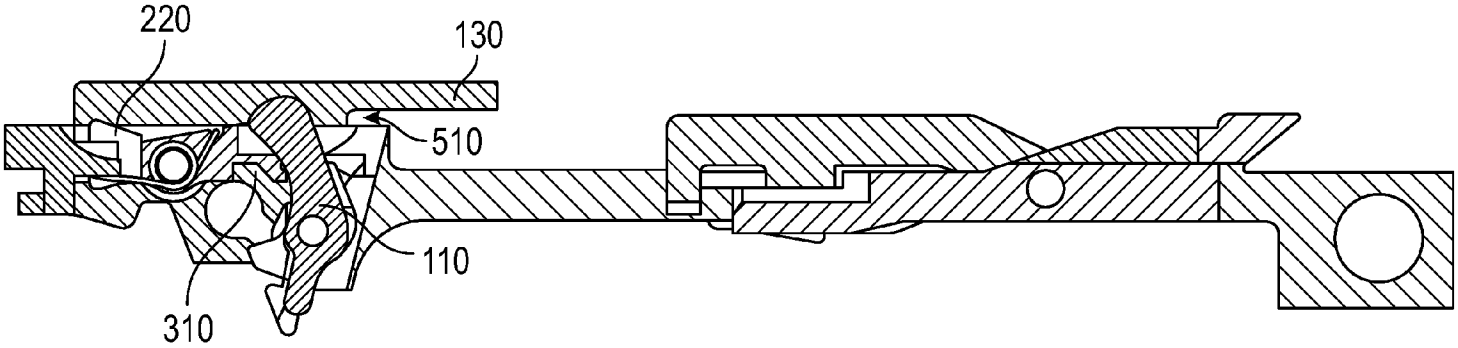
FIG. 21D is a side view cross-section of the firearm of FIG. 21A along section line C-C.

FIG. 21D is a side view cross-section of FIG. 21A along section line C-C. Striker block actuator 110 remains in position while trigger assembly 538 is fully retracted.

FIG. 22 is a right side cross-sectional view of a firearm of the present disclosure, wherein the slide is traveling back to battery position. Striker 502 is retained by sear 106. Sear block 104 rotates back into its initial position. New cartridge 560 is stripped from the magazine (not shown) into chamber 514. Recoil spring 544 forces slide 600 forward to battery position.

Figure 23A:
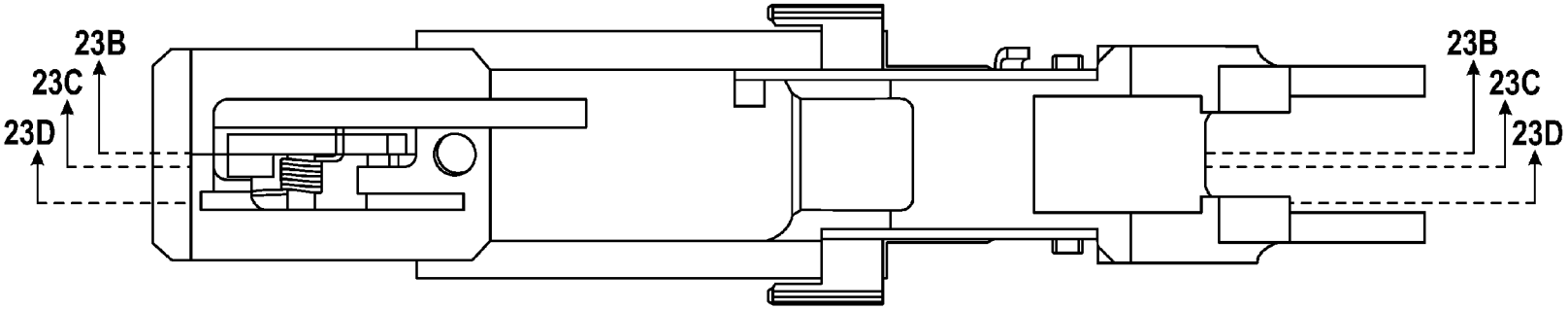
FIG. 23A is a top view schematic illustration of a firearm having a sear mechanism of the present invention in the firing stage with trigger at maximum pull of FIG. 22. Section lines A-A, B-B, and C-C are shown in side cross-section in FIGS. 23B, 23C, and 23D, respectively.

FIG. 23A is a top view schematic illustration of a firearm of FIG. 22 having a sear mechanism of the present invention in the firing stage with trigger at maximum pull. Section lines A-A, B-B, and C-C are shown in side cross-section in FIGS. 23B, 23C, and 23D, respectively.

Figure 23B:
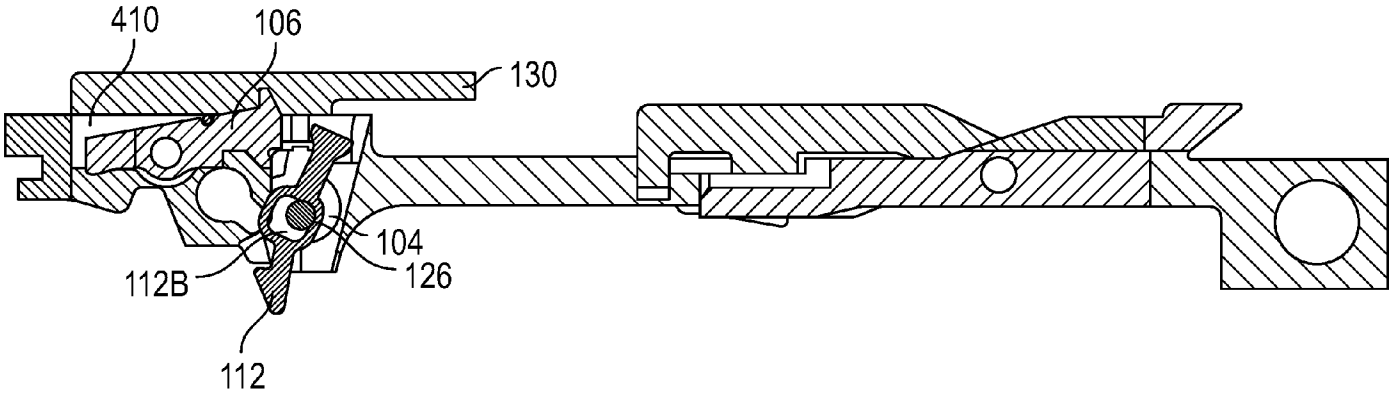
FIG. 23B is a side cross-section of the firearm of FIG. 23A along section line A-A.

FIG. 23B is a side view cross-section of FIG. 23A along section line A-A. At maximum trigger pull and with sear 106 in its initial position, sear block 104 has rotated counter-clockwise back into its original position shown in FIG. 2 and FIGS. 6A-D.

Figure 23C:
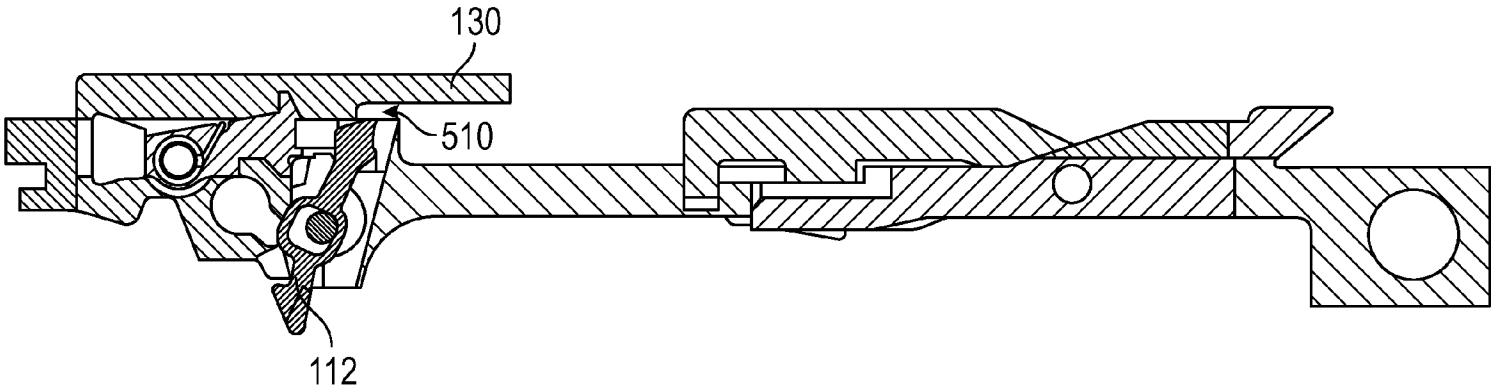
FIG. 23C is a side view cross-section of the firearm of FIG. 23A along section line B-B.

FIG. 23C is a side view cross-section of FIG. 23A along section line B-B and provides an alternative view of the rotation of sear block 104 as well as the cam surfaces of disconnector 112 and sear 106.

Figure 23D:
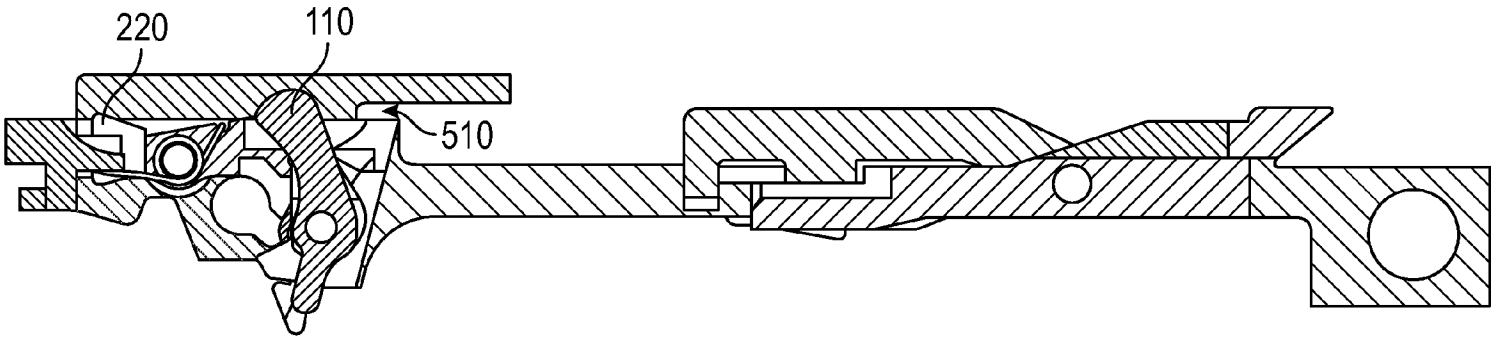
FIG. 23D is a side view cross-section of the firearm of FIG. 23A along section line C-C.

FIG. 23D is a side view cross-section of FIG. 23A along section line C-C. Sear block 104 rotation has occurred and is obscured by striker block actuator 110.

Figure 24A:
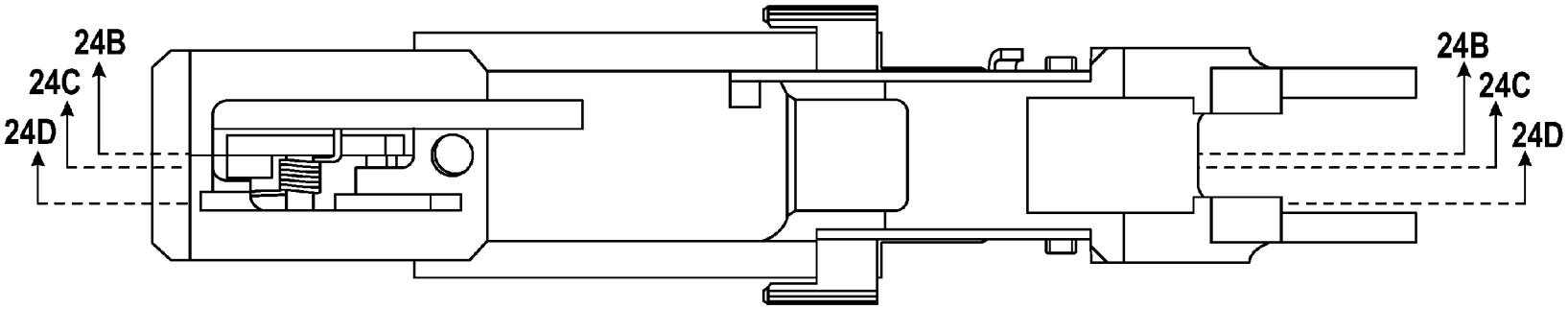
FIG. 24A is a top view schematic illustration of a firearm of FIGS. 23A-D, wherein the trigger has been released after firing a round. Section lines A-A, B-B, and C-C are shown in side cross-section in FIGS. 24B, 24C, and 24D, respectively.

FIG. 24A is a top view schematic illustration of a firearm of FIGS. 23A-D, wherein the trigger has been released after firing a round. Section lines A-A, B-B, and C-C are shown in side cross-section in FIGS. 24B, 24C, and 24D, respectively. FIGS. 24A-D illustrate a transition back to battery after the trigger is released. As disconnector 112 bottom cam translates forward, note the position of disconnector bore 112B with respect to pin 126 in the upper left corner of bore 112B.

Figure 24B:
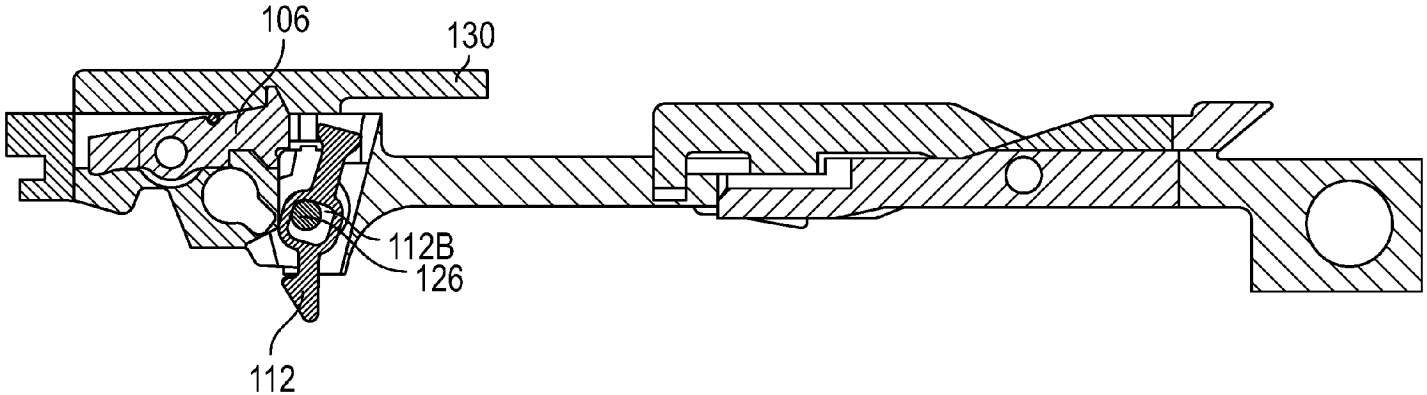
FIG. 24B is a side cross-section of the firearm of FIG. 24A along section line A-A.

FIG. 24B is a side cross-section of FIG. 24A along section line A-A, detailing the position of disconnector 112 relative to pin 126. The trigger has been released, allowing disconnector 112 to rotate counter-clockwise and translate forward (distally).

Figure 24C:
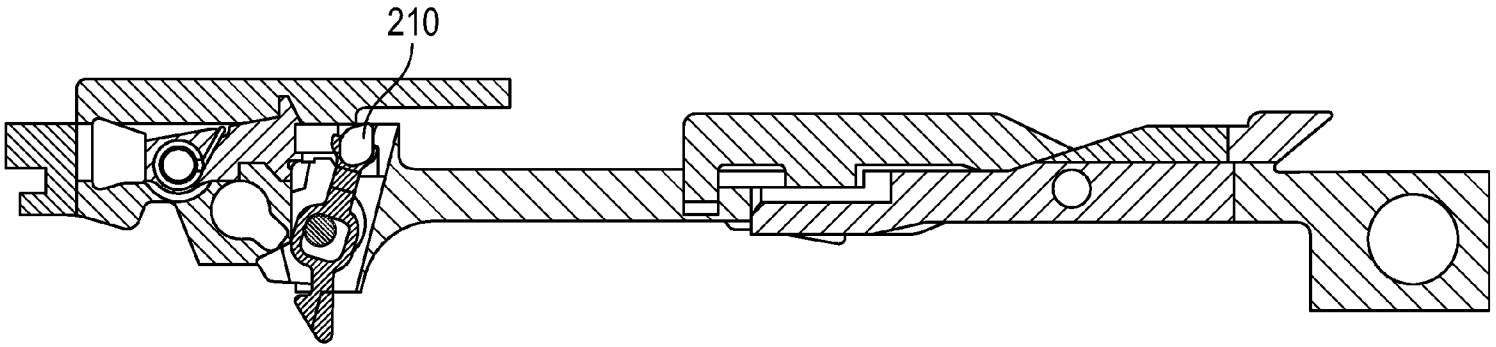
FIG. 24C is a side view cross-section of the firearm of FIG. 24A along section line B-B.

FIG. 24C is a side view cross-section of the firearm of FIG. 24A along section line B-B. Disconnector cam 210 is shown as engaged and forward.

Figure 24D:
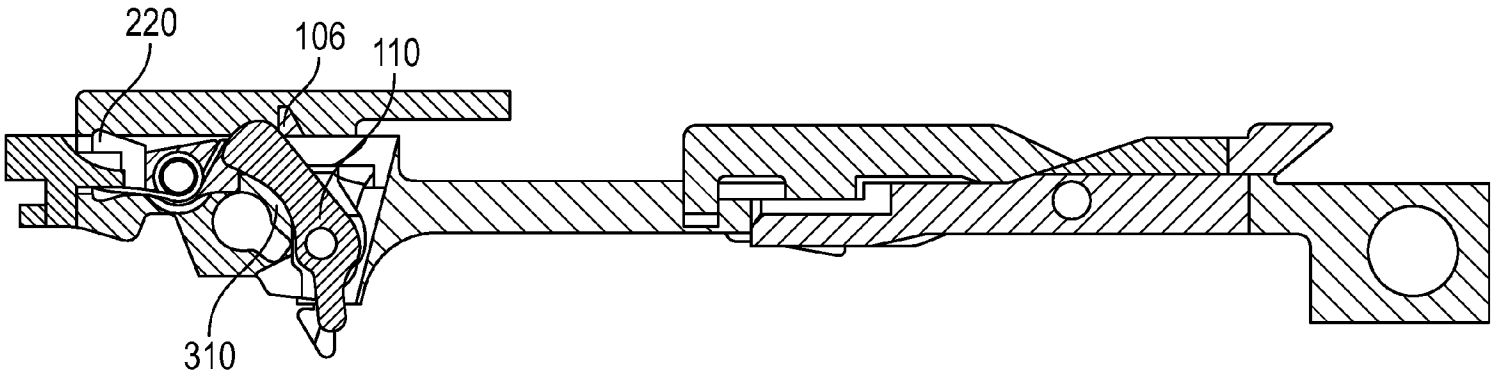
FIG. 24D is a side view cross-section of the firearm of FIG. 24A along section line C-C.

FIG. 24D is a side view cross-section of FIG. 24A along section line C-C. The trigger has been released, allowing striker block actuator 110 to rotate counter-clockwise relative to pin 126.

Figure 25A:
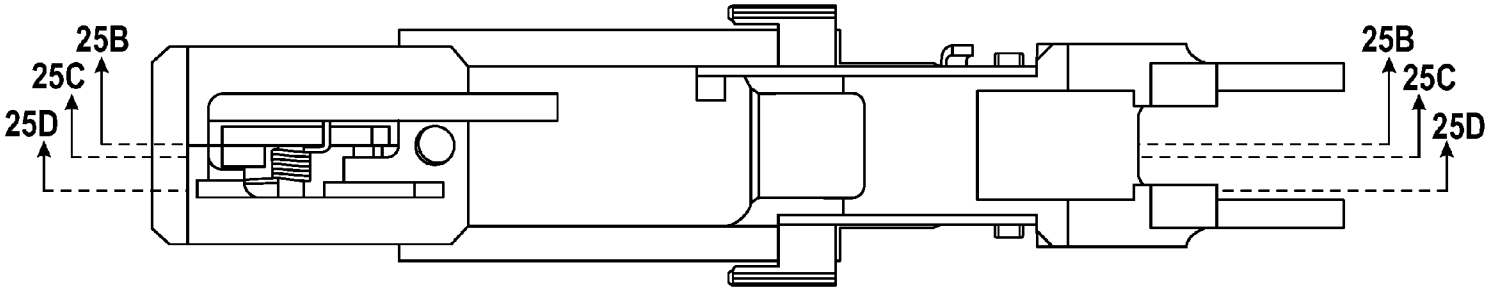
FIG. 25A is a top view schematic illustration of a firearm of FIGS. 24A-D, wherein the firing state has returned to the battery position of FIG. 2. Section lines A-A, B-B, and C-C are shown in side cross-section in FIGS. 25B, 25C, and 25D, respectively.

FIG. 25A is a top view schematic illustration of a firearm of FIGS. 24A-D, wherein the firing state has returned to the battery position of FIG. 2. Section lines A-A, B-B, and C-C are shown in side cross-section in FIGS. 25B, 25C, and 25D, respectively. Cam surface 542 of slide 600 is clear which allows disconnector 112 to translate upward to reconnect with sear block 104 for subsequent fire.

Figure 25B:
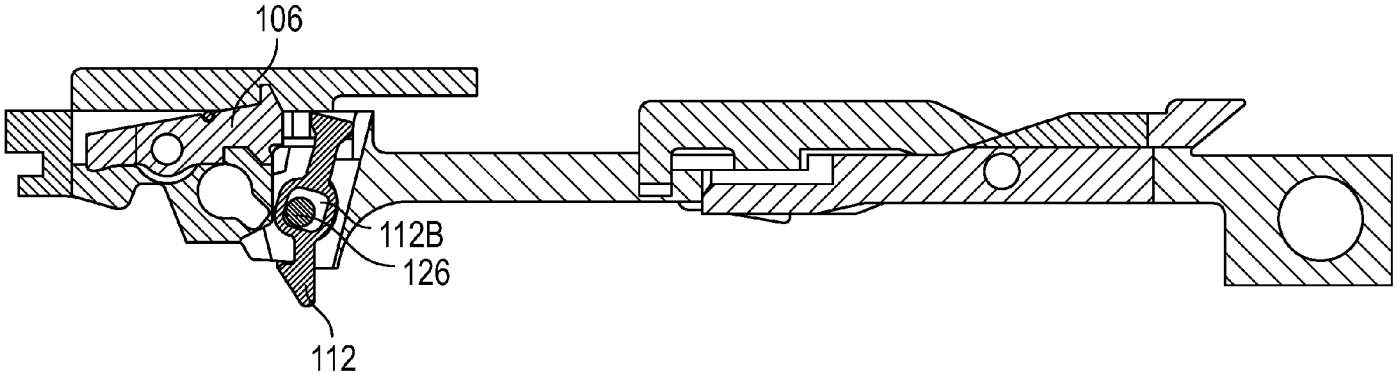
FIG. 25B is a side view cross-section of the firearm of FIG. 25A along section line A-A.

FIG. 25B is a side cross-section of FIG. 25A along section line A-A. Disconnector 112 has returned to the original position such that pin 126 is in the lower left corner of bore 112B.

Figure 25C:
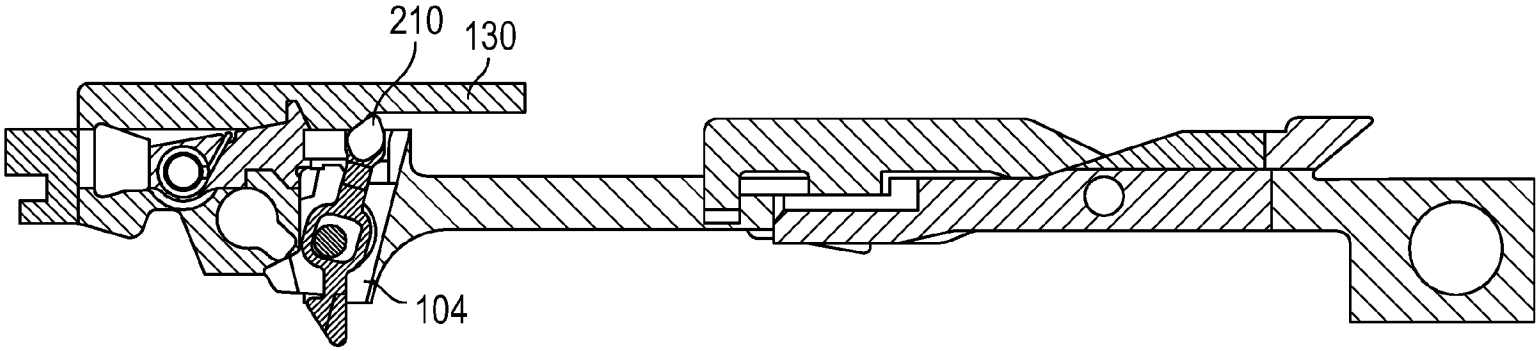
FIG. 25C is a side view cross-section of the firearm of FIG. 25A along section line B-B.

FIG. 25C is a side view cross-section of the firearm of FIG. 25A along section line B-B. Disconnector 112 is lifted up.

Figure 25D:
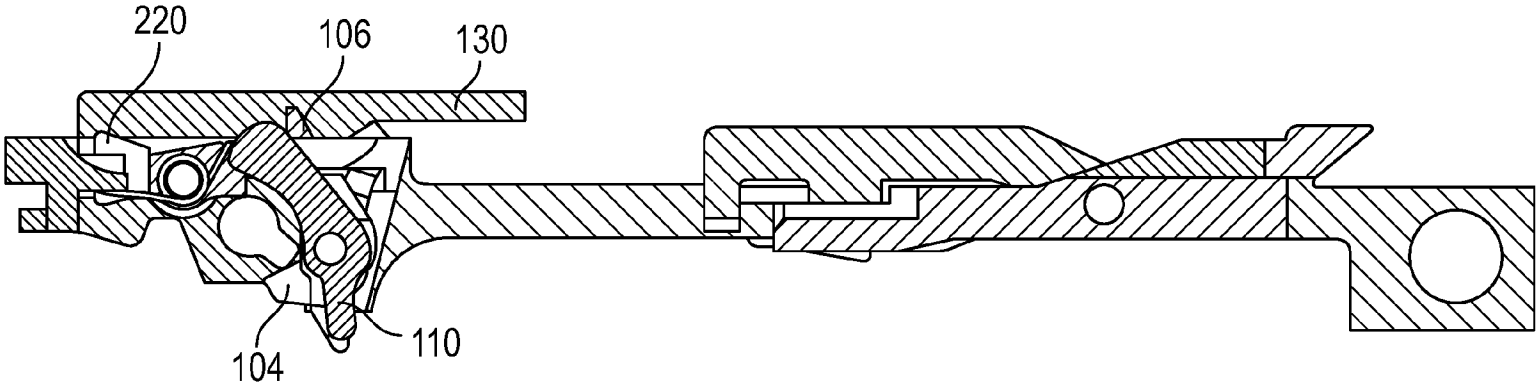
FIG. 25D is a side view cross-section of the firearm of FIG. 25A along section line C-C.

FIG. 25D is a side view cross-section of the firearm of FIG. 25A along section line C-C. Striker block actuator 110 is in its original position.

Functional Description

Weapon is in Battery Ready to Fire

The sear is engaged with the striker and the sear block physically holds the sear in place, which creates a positive sear engagement. A striker block located within the slide is also disallowing the striker to move towards the primer in case of a drop shock or similar occurrence. The thumb safety and trigger safety are engaged.

The thumb safety is disengaged by rotating the external safety levers upwards with respect to the weapon. The trigger safety is disengaged by depressing the forward trigger lever and retracting towards the rear of the weapon.

The trigger yoke presses on the disconnector cam within the fire control assembly. The disconnector engages the sear block and begins to rotate the sear block at the trigger assembly is depressed. The trigger yoke is simultaneously rotating the striker block actuator which is depressing the striker block within the slide of the weapon. Trigger is completely depressed The trigger yoke has rotated the sear block from beneath the sear while simultaneously rotating the striker block actuator releasing the striker block. Once the striker block and the sear blocks are disengaged, the sear will drop and the striker will now move towards the primer of the cartridge and ignite. The bullet will exit the barrel towards the target.

Post Ignition

The explosion that results from ignition of the primer by the striker applies force on the breach face of the slide and begins translating the slide rearward. The barrel will translate with the slide for a brief period before the barrel cams engage with the barrel lugs and then begin a rotational and translational movement. As the slide continues the rearward travel, it is performing three operations with respect to the sear mechanism: (1) A cam on the underside of the slide will actuate the disconnector to disengage from the sear block, (2) move the striker rearward of the sear, and (3) also a cam on the underside of the slide will rotate the sear back into position. Once these three operations occur, a sear block leaf spring will rotate the sear block back into position underneath the sear to provide the positive sear engagement.

Slide Travels Back into Battery

The striping feature on the slide will strip the next round from the magazine and push the round up the barrel feature into the barrel chamber. The striker will engage the sear and the slide will push the barrel back into battery position where it is biased onto the take down pin.

Notes about the Disconnector and Other Features and Advantages

Disconnector is actuated anytime the slide is not in the battery position. In other words, the trigger will have no effect on the sear mechanism while not in battery. If the sear lever is dropped and the slide is manually retracted, the cams in the slide will actuate the sear to reengage the striker. If the sear lever is in battery position and the slide is manually retracted, the cams on the slide will have no effect on the sear but the slide will still disconnect the trigger.

The use of an isolated rotational sear of the present disclosure provides many advantages over the prior art including, the allowance for a 1911-style translational trigger yoke to be used which gives the shooter the advantages of a short, crisp trigger pull without any off-axis movement. The positive sear engagement and inherent safety of the design are achieved due to the sear being engaged and biased onto the sear block surface, disallowing unintended or accidental release.

The sear housing has been expanded, relative to typical sear housings, to include the forward barrel cams and the takedown pins bores integrated within a single chassis.

A spring biases the sear into the sear block. Tines from a leaf spring integral to the weapon grip biases the sear block and disconnector.

The barrel interacts with a camming feature on the manifold sear housing.

Many modifications and other embodiments of the sear and disconnector mechanism described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A firearms sear assembly, the sear assembly comprising:

a sear housing;

a sear block disposed in the sear housing, the sear block further comprising a disconnector receiving slot;

a sear operably mounted on the sear block; the sear consisting of a monolithic piece comprising a first lateral side;

a distal end;

a proximate end;

a cam located at the proximate end and on the first lateral side;

a ledge adjacent to the cam on the proximate end;

a bias spring attachment portion between the distal end and the proximate end;

a bias spring operably attached to the bias spring attachment portion;

a disconnector operably installed in the sear block disconnector receiving slot; the disconnector further comprising a cam;

a striker block actuator disposed in the sear block adjacent to the disconnector cam and operably interactive with a striker block; and a striker block operably actuated by the striker block actuator.

2. The firearms sear mechanism of claim 1, wherein the firearms comprise a pistol.

3. The firearms sear mechanism of claim 2, wherein the pistol comprises a translational trigger to actuate the sear assembly.

4. The firearms sear mechanism of claim 3, wherein the firearms sear assembly is rotational.

5. The firearms sear mechanism of claim 2, wherein the pistol comprises a striker firing mechanism released by actuating the sear assembly.

6. The firearms sear mechanism of claim 2, wherein the pistol maintains positive sear engagement.

7. The firearms sear mechanism of claim 1, wherein the pistol comprises a translational trigger to actuate the sear assembly.

8. A firearms sear consisting of a monolithic unitary piece comprising a first lateral side;

a distal end;

a proximate end;

a cam located at the proximate end and on the first lateral side;

a ledge adjacent to the cam on the proximate end; and a bias spring attachment portion between the distal portion and the proximate end.

9. A firearm comprising a translational trigger and a rotational sear assembly wherein rotation of the rotational sear assembly is actuated by the translational trigger, the sear assembly further comprising a monolithic sear having a first lateral side, a distal end, a proximate end, a cam located at the proximate end and on the first lateral side, a ledge adjacent to the cam on the proximate end, and a bias sprint attachment portion between the distal end and the proximate end.

10. The Firearm of claim 9, wherein the firearm comprises a pistol.

11. The firearm of claim 9, further comprising a trigger yoke in mechanical communication with and between the translational trigger and the rotational sear assembly, wherein the translational trigger translates the trigger yoke to actuate the rotational sear assembly.

12. The firearm of claim 9, further comprising a striker firing mechanism released by actuating the rotational sear assembly.

* * * * *